US008596230B2

(12) United States Patent
Sturman et al.

(10) Patent No.: US 8,596,230 B2
(45) Date of Patent: Dec. 3, 2013

(54) HYDRAULIC INTERNAL COMBUSTION ENGINES

(75) Inventors: Oded Eddie Sturman, Woodland Park, CO (US); Tibor Kiss, Colorado Springs, CO (US); Steven E. Massey, Woodland Park, CO (US); David Drury, Colorado Springs, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 268 days.

(21) Appl. No.: 12/901,915

(22) Filed: Oct. 11, 2010

(65) Prior Publication Data

US 2011/0083643 A1 Apr. 14, 2011

Related U.S. Application Data

(60) Provisional application No. 61/250,784, filed on Oct. 12, 2009, provisional application No. 61/298,479, filed on Jan. 26, 2010, provisional application No. 61/300,403, filed on Feb. 1, 2010, provisional application No. 61/320,943, filed on Apr. 5, 2010.

(51) Int. Cl.
*F02B 71/00* (2006.01)

(52) U.S. Cl.
USPC ..... 123/46 R; 123/46 SC

(58) Field of Classification Search
USPC ..... 123/46 R, 46 B, 46 SC, 46 E
See application file for complete search history.

(56) References Cited

U.S. PATENT DOCUMENTS

| | | | |
|---|---|---|---|
| 1,062,999 | A | 5/1913 | Webb |
| 2,058,705 | A | 10/1936 | Maniscalco |
| 2,661,592 | A | 12/1953 | Bright |
| 2,902,207 | A | 9/1959 | Burion |
| 3,065,703 | A | 11/1962 | Harman |
| 3,170,406 | A | 2/1965 | Robertson |

(Continued)

FOREIGN PATENT DOCUMENTS

| | | |
|---|---|---|
| DE | 37 27 335 | 2/1988 |
| DE | 4024591 | 2/1992 |

(Continued)

OTHER PUBLICATIONS

Alson, Jeff, et al., "Progress Report on Clean and Efficient Automotive Technologies Under Development at the EPA", *United States Environmental Protection Agency*, EPA420-R-04-002, (Jan. 2004), 198 pp total.

(Continued)

*Primary Examiner* — Noah Kamen
*Assistant Examiner* — Long T Tran
(74) *Attorney, Agent, or Firm* — Blakely Sokoloff Taylor & Zafman LLP

(57) ABSTRACT

Hydraulic internal combustion engines having at least one combustion piston not mechanically connected to a crankshaft or any other combustion piston, but instead acting on hydraulic plungers through valving that is electronically controlled to control the piston position and velocity, typically through an intake stroke, a compression stroke, a combustion or power stroke and an exhaust stroke. Electronically controlled fuel injection and electronically controlled engine valves provided great flexibility in the operating cycles that may be used, with the engine pumping hydraulic fluid to a high pressure accumulator for use in hydraulic motors or other hydraulic equipment. Embodiments using high pressure air injection to sustain combustion are also disclosed.

17 Claims, 16 Drawing Sheets

(56) References Cited

U.S. PATENT DOCUMENTS 3,209,737 A 10/1965 Omotehara et al.
3,532,121 A 10/1970 Sturman et al.
3,623,463 A 11/1971 De Vries
3,683,239 A 8/1972 Sturman
3,743,898 A 7/1973 Sturman
3,859,966 A 1/1975 Braun
3,952,710 A 4/1976 Kawarada et al.
3,995,974 A 12/1976 Herron
4,009,695 A 3/1977 Ule
4,097,198 A 6/1978 Herron
4,162,662 A 7/1979 Melchior
4,192,265 A 3/1980 Amano
4,312,038 A 1/1982 Imai et al.
4,326,380 A * 4/1982 Rittmaster et al. ..... 60/595
4,333,424 A 6/1982 McFee
4,396,037 A 8/1983 Wilcox
4,403,474 A * 9/1983 Ruthven ..... 60/396
4,409,638 A 10/1983 Sturman et al.
4,435,133 A 3/1984 Meulendyk
RE32,163 E 5/1986 Tokuda et al.
4,599,861 A * 7/1986 Beaumont ..... 60/595
4,779,582 A 10/1988 Lequesne
4,783,966 A 11/1988 Aldrich
4,887,562 A 12/1989 Wakeman
4,906,924 A 3/1990 Zannis
4,930,464 A 6/1990 Letsche
5,003,937 A 4/1991 Matsumoto et al.
5,022,358 A 6/1991 Richeson
5,121,730 A 6/1992 Ausman et al.
5,124,598 A 6/1992 Kawamura
5,170,755 A 12/1992 Kano et al.
5,193,495 A 3/1993 Wood, III
5,209,453 A 5/1993 Aota et al.
5,224,683 A 7/1993 Richeson
5,237,968 A 8/1993 Miller et al.
5,237,976 A 8/1993 Lawrence et al.
5,248,123 A 9/1993 Richeson et al.
5,255,641 A 10/1993 Schechter
5,275,134 A 1/1994 Springer
5,275,136 A 1/1994 Schechter et al.
5,327,856 A 7/1994 Schroeder et al.
5,331,277 A 7/1994 Burreson
5,335,633 A 8/1994 Thien
5,339,777 A 8/1994 Cannon
5,363,651 A 11/1994 Knight
5,367,990 A 11/1994 Schechter
5,373,817 A 12/1994 Schechter et al.
5,408,975 A 4/1995 Blakeslee et al.
5,410,994 A 5/1995 Schechter
5,419,492 A 5/1995 Gant et al.
5,421,521 A 6/1995 Gibson et al.
5,448,973 A 9/1995 Meyer
5,460,329 A 10/1995 Sturman
5,463,996 A 11/1995 Maley et al.
5,471,959 A 12/1995 Sturman
5,473,893 A 12/1995 Achten et al.
5,482,445 A 1/1996 Achten et al.
5,494,219 A 2/1996 Maley et al.
5,499,605 A 3/1996 Thring
5,507,316 A 4/1996 Meyer
5,526,778 A 6/1996 Springer
5,540,193 A 7/1996 Achten et al.
5,546,897 A 8/1996 Brackett
5,551,398 A 9/1996 Gibson et al.
5,556,262 A 9/1996 Achten et al.
5,572,961 A 11/1996 Schechter et al.
5,577,468 A 11/1996 Weber
5,598,871 A 2/1997 Sturman et al.
5,622,152 A 4/1997 Ishida
5,628,293 A 5/1997 Gibson et al.
5,638,781 A 6/1997 Sturman
5,640,987 A 6/1997 Sturman
5,647,734 A 7/1997 Milleron
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,700,136 A 12/1997 Sturman
5,713,316 A 2/1998 Sturman
5,720,261 A 2/1998 Sturman et al.
5,732,677 A 3/1998 Baca
5,738,075 A 4/1998 Chen et al.
5,752,659 A 5/1998 Moncelle
5,813,841 A 9/1998 Sturman
5,829,393 A 11/1998 Achten et al.
5,829,396 A 11/1998 Sturman
5,857,436 A 1/1999 Chen
5,873,526 A 2/1999 Cooke
5,894,730 A * 4/1999 Mitchell ..... 60/595
5,937,799 A 8/1999 Binion
5,954,030 A 9/1999 Sturman et al.
5,960,753 A 10/1999 Sturman
5,970,956 A 10/1999 Sturman
5,979,803 A 11/1999 Peters et al.
5,983,638 A * 11/1999 Achten et al. ..... 60/595
6,005,763 A 12/1999 North
6,012,430 A 1/2000 Cooke
6,012,644 A 1/2000 Sturman et al.
6,085,991 A 7/2000 Sturman
6,105,616 A 8/2000 Sturman et al.
6,109,284 A 8/2000 Johnson et al.
6,148,778 A 11/2000 Sturman
6,152,091 A * 11/2000 Bailey et al. ..... 123/46 R
6,158,401 A * 12/2000 Bailey ..... 123/46 SC
6,161,770 A 12/2000 Sturman
6,170,442 B1 * 1/2001 Beale ..... 123/46 B
6,173,685 B1 1/2001 Sturman
6,206,656 B1 * 3/2001 Bailey et al. ..... 417/364
6,257,499 B1 7/2001 Sturman
6,269,783 B1 * 8/2001 Bailey ..... 123/46 R
6,279,517 B1 8/2001 Achten
6,308,690 B1 10/2001 Sturman
6,314,924 B1 * 11/2001 Berlinger ..... 123/46 R
6,360,728 B1 3/2002 Sturman
6,412,706 B1 7/2002 Guerrassi et al.
6,415,749 B1 7/2002 Sturman et al.
6,463,895 B2 * 10/2002 Bailey ..... 123/46 R
6,497,216 B2 12/2002 Gaessler et al.
6,543,411 B2 4/2003 Raab et al.
6,551,076 B2 * 4/2003 Boulware ..... 417/380
6,557,506 B2 5/2003 Sturman
6,575,126 B2 6/2003 Sturman
6,575,384 B2 6/2003 Ricco
6,592,050 B2 7/2003 Boecking
6,655,355 B2 12/2003 Kropp et al.
6,684,856 B2 2/2004 Tanabe et al.
6,684,857 B2 2/2004 Boecking
6,739,293 B2 5/2004 Turner et al.
6,769,405 B2 8/2004 Leman et al.
6,863,507 B1 3/2005 Schaeffer et al.
6,910,462 B2 6/2005 Sun et al.
6,910,463 B2 6/2005 Oshizawa et al.
6,931,845 B2 8/2005 Schaeffer
6,948,459 B1 * 9/2005 Laumen et al. ..... 123/46 R
6,951,204 B2 10/2005 Shafer et al.
6,951,211 B2 10/2005 Bryant
6,953,010 B1 * 10/2005 Hofbauer ..... 123/46 R
6,957,632 B1 * 10/2005 Carlson et al. ..... 123/46 R
6,971,341 B1 * 12/2005 Fuqua et al. ..... 123/46 R
6,994,077 B2 2/2006 Kobayashi et al.
6,999,869 B1 2/2006 Gitlin et al.
7,025,326 B2 4/2006 Lammert et al.
7,032,548 B2 * 4/2006 Tusinean ..... 123/46 R
7,032,574 B2 4/2006 Sturman
7,108,200 B2 9/2006 Sturman
7,128,062 B2 10/2006 Kuo et al.
7,182,068 B1 2/2007 Sturman et al.
7,258,086 B2 * 8/2007 Fitzgerald ..... 123/46 R
7,341,028 B2 3/2008 Klose et al.
7,353,786 B2 4/2008 Scuderi et al.
7,387,095 B2 6/2008 Babbitt et al.
7,412,969 B2 8/2008 Pena et al.
7,481,039 B2 1/2009 Surnilla et al.

(56) References Cited

U.S. PATENT DOCUMENTS

| | | | | |
|---|---|---|---|---|
| 7,568,632 | B2 | 8/2009 | Sturman | |
| 7,568,633 | B2 | 8/2009 | Sturman | |
| 7,694,891 | B2 | 4/2010 | Sturman | |
| 7,717,359 | B2 | 5/2010 | Sturman | |
| 7,730,858 | B2 | 6/2010 | Babbitt et al. | |
| 7,793,638 | B2 | 9/2010 | Sturman | |
| 7,954,472 | B1 | 6/2011 | Sturman | |
| 7,958,864 | B2 | 6/2011 | Sturman | |
| 8,196,844 | B2 | 6/2012 | Kiss et al. | |
| 8,282,020 | B2 | 10/2012 | Kiss et al. | |
| 8,342,153 | B2 | 1/2013 | Sturman | |
| 2001/0017123 | A1 | 8/2001 | Raab et al. | |
| 2001/0020453 | A1* | 9/2001 | Bailey | 123/46 SC |
| 2002/0017573 | A1 | 2/2002 | Sturman | |
| 2002/0076339 | A1 | 6/2002 | Boulware | |
| 2002/0166515 | A1 | 11/2002 | Ancimer et al. | |
| 2003/0015155 | A1 | 1/2003 | Turner et al. | |
| 2003/0041593 | A1 | 3/2003 | Yoshida et al. | |
| 2003/0226351 | A1 | 12/2003 | Glenn | |
| 2004/0045536 | A1 | 3/2004 | Hafner et al. | |
| 2004/0177837 | A1 | 9/2004 | Bryant | |
| 2005/0098162 | A1 | 5/2005 | Bryant | |
| 2005/0247273 | A1 | 11/2005 | Carlson | |
| 2006/0032940 | A1 | 2/2006 | Boecking | |
| 2006/0192028 | A1 | 8/2006 | Kiss | |
| 2006/0243253 | A1 | 11/2006 | Knight | |
| 2007/0007362 | A1 | 1/2007 | Sturman | |
| 2007/0113906 | A1 | 5/2007 | Sturman et al. | |
| 2007/0245982 | A1 | 10/2007 | Sturman | |
| 2008/0092860 | A2 | 4/2008 | Bryant | |
| 2008/0264393 | A1 | 10/2008 | Sturman | |
| 2008/0275621 | A1 | 11/2008 | Kobayashi | |
| 2009/0037085 | A1 | 2/2009 | Kojima | |
| 2009/0183699 | A1 | 7/2009 | Sturman | |
| 2009/0199789 | A1 | 8/2009 | Beard | |
| 2009/0199819 | A1 | 8/2009 | Sturman | |
| 2009/0250035 | A1 | 10/2009 | Washko | |
| 2009/0271088 | A1* | 10/2009 | Langham | 701/102 |
| 2010/0012745 | A1 | 1/2010 | Sturman | |
| 2010/0186716 | A1 | 7/2010 | Sturman | |
| 2010/0277265 | A1 | 11/2010 | Sturman et al. | |
| 2011/0083643 | A1* | 4/2011 | Sturman et al. | 123/46 R |
| 2011/0163177 | A1 | 7/2011 | Kiss | |
| 2012/0080110 | A1 | 4/2012 | Kiss et al. | |

FOREIGN PATENT DOCUMENTS

| | | |
|---|---|---|
| DE | 10239110 | 3/2004 |
| FR | 2901846 | 12/2007 |
| GB | 941453 | 11/1963 |
| GB | 2402169 | 12/2004 |
| JP | 60-035143 | 2/1985 |
| WO | WO-92/02730 | 2/1992 |
| WO | WO-93/10344 | 5/1993 |
| WO | WO-97/35104 | 9/1997 |
| WO | WO-98/11334 | 3/1998 |
| WO | WO-98/54450 | 12/1998 |
| WO | WO-01/46572 | 6/2001 |
| WO | WO-02/086297 | 10/2002 |
| WO | WO-2008/014399 | 1/2008 |

OTHER PUBLICATIONS

Brueckner, Stephen, "Reducing Greenhouse Gas Emissions From Light-Duty Motor Vehicles", *California Air Resources Board (ARB) Workshop*, (Apr. 20, 2004), pp. 1-37.

Kang, Hyungsuk, et al., "Demonstration of Air-Power-Assist (APA) Engine Technology for Clean Combustion and Direct Energy Recovery in Heavy Duty Application", *SAE Technical Paper Series* 2008-01-1197, (Apr. 14-17, 2008), 9 pp total.

Nehmer, Daniel A., et al., "Development of a Fully Flexible Hydraulic Valve Actuation Engine, Part I: Hydraulic Valve Actuation System Development", *Proceedings of the 2002 Global Powertrain Congress (GPC) on Advanced Engine Design and Performance*, (2002), 12 pp total.

Ricardo, Inc., "A Study of Potential Effectiveness of Carbon Dioxide Reducing Vehicle Technologies, Revised Final Report", *United States Environmental Protection Agency* EPA420-R-08-004A, EPA Contract No. EP-C-06-003, Work Assignment No. 1-14, (Jun. 2008), 126 pp total.

Sheehan, John, et al., "An Overview of Biodiesel and Petroleum Diesel Life Cycles", A Joint Study Spolsored by: U.S. Department of Agriculture and U.S. Department of Energy, (May 1998), 60 pp total.

Vance, Evelyn, et al., "Advanced Fuel Injection System and Valve Train Technologies", SBIR Phase II Project Final Report, SBIR Contract No. W56HZV-07-C-0528, (Oct. 19, 2009), pp. 1-237.

Yamaguchi, T., et al., "Improvements for Volumetric Efficiency and Emissions using Digital Hydraulic VVA in a High Boosting Diesel Engine", *Thiesel 2008 Conference on Thermo- and Fluid Dynamic Processes in Diesel Engines*, (2008), pp. 1-13.

"International Search Report and Written Opinion of the International Searching Authority Dated Jan. 20, 2011", International Application No. PCT/US2010/052391.

Anderson, Mark D., et al., "Adaptive Lift Control for a Camless Electrohydraulic Valvetrain", *SAE Paper No. 981029*, U. of Illinois and Ford Motor Co., (Feb. 23, 1998).

Blair, Gordon P., "Design and Simulation of Two-Stroke Engines", *SAE Publications No. R-161*, (1996), pp. 1-48.

Challen, Bernard, "Diesel Engine Reference Book Second Edition", *SAE Publication No. R-183*, (1999), pp. 27-71.

Cole, C., et al., "Application of Digital Valve Technology to Diesel Fuel Injection", *SAE Paper No. 1999-01-0196*, Sturman Industries, Inc., (Mar. 1, 1999).

Dickey, Daniel W., et al., "NOx Control in Heavy-Duty Diesel Engines—What is the Limit?", *In-Cylinder Diesel Particulate and NOx Control*, SAE Publication No. SP-1326, (1998), pp. 9-20.

Duret, P., "A New Generation of Two-Stroke Engines for the Year 2000", *A New Generation of Two-Stroke Engines for the Future?*, Paris, (1993), pp. 181-194.

Heisler, Heinz, "Vehicle and Engine Technology Second Edition", *SAE International*, London, (1999), pp. 292-308.

Kang, Kern Y., "Characteristics of Scavenging Flow in a Poppet-Valve Type 2-Stroke Diesel Engine by Using RSSV System", *Progress in Two-Stroke Engine and Emissions Control*, SAE Publication SP-1131, (1998), pp. 93-101.

Kim, Dean H., et al., "Dynamic Model of a Springless Electrohydraulic Valvetrain", *SAE Paper No. 970248*, U. of Illinois and Ford Research Company, (1997).

Misovec, Kathleen M., et al., "Digital Valve Technology Applied to the Control of an Hydraulic Valve Actuator", *SAE Paper No. 1999-01-0825*, Sturman Industries, Inc., (Mar. 1, 1999).

Nomura, K., et al., "Development of a New Two-Stroke Engine with Poppet-Valves: Toyota S-2 Engine", *A New Generation of Two-Stroke Engines for the Future?*, (1993), pp. 53-62.

Nuti, Marco, et al., "Twenty Years of Piaggio Direct Injection Research to Mass Produced Solution for Small 2T SI Engines", *Two-Stroke Engines and Emissions*, SAE Publication SP-1327, (1998), pp. 65-78.

Osenga, Mike, "Cat's HEUI System: A Look at the Future?", *Diesel Progress*, (Apr. 1995), pp. 30-35.

Schechter, Michael M., et al., "Camless Engine", *SAE Paper No. 960581*, Ford Research Lab, (Feb. 26, 1996).

Sturman, Carol, et al., "Breakthrough in Digital Valves", *Machine Design*, (Feb. 21, 1994), pp. 37-42.

Wilson, Rob, "Developments in Digital Valve Technology", *Diesel Progress North American Edition*, (Apr. 1997), pp. 76, 78-79.

Wirbeleit, F., et al., "Stratified Diesel Fuel-Water-Diesel Fuel Injection Combined with EGR—The Most Efficient In-Cylinder NOx and PM Reduction Technology", *Combustion and Emissions in Diesel Engines*, SAE Publication No. SP-1299, (1997), pp. 39-44.

(56) References Cited

OTHER PUBLICATIONS

U.S. Appl. No. 13/181,437, filed Jul. 12, 2011.
U.S. Appl. No. 13/526,914, filed Jun. 19, 2012.
U.S. Appl. No. 13/554,123, filed Jul. 20, 2012.
"International Search Report and Written Opinion of the International Searching Authority Dated Apr. 18, 2013, International Application No. PCT/US2012/047805", (Apr. 18, 2013).
"International Search Report and Written Opinion of the International Searching Authority Dated Jan. 31, 2013, International Application No. PCT/US2012/043393", (Jan. 31, 2013).
"Partial International Search Report and Invitation to Pay Additional Fees by the International Searching Authority Dated Feb. 6, 2013, International Application No. PCT/US2012/047805", (Feb. 6, 2013).
"Office Action Dated Sep. 6, 2013; U.S. Appl. No. 13/526,914", (Sep. 6, 2013).

* cited by examiner

I-6

HYDRAULIC INTERNAL COMBUSTION ENGINES

CROSS-REFERENCE TO RELATED APPLICATIONS

This application claims the benefit of U.S. Provisional Patent Application No. 61/250,784 filed Oct. 12, 2009, U.S. Provisional Patent Application No. 61/298,479 filed Jan. 26, 2010, U.S. Provisional Patent Application No. 61/300,403 filed Feb. 1, 2010 and U.S. Provisional Patent Application No. 61/320,943 filed Apr. 5, 2010.

BACKGROUND OF THE INVENTION

1. Field of the Invention

The present invention relates to the field of free piston engines and power trains therefore.

2. Prior Art

Internal combustion engines are useful devices for converting chemical energy to mechanical energy by combustion. Typical internal combustion engines convert the energy in petrochemical fuels such as gasoline or diesel fuel to rotary mechanical energy by using the pressure created by confined combustion to force a piston downward as the combustion gases expand and to convert that motion into a rotary motion by use of a crankshaft. However, the use of the piston and crankshaft mechanism introduces many constraints in the operation of the engine that limit the amount of useful mechanical energy that can be extracted from the combustion process.

Free piston engines are linear, "crankless" internal combustion engines, in which the piston motion is not controlled by a crankshaft but is determined by the interaction of forces from the combustion chamber gases, a rebound device and a load device. Hydraulic free piston engines couple the combustion piston to a hydraulic cylinder that acts as both the load and rebound device using a hydraulic control system. This gives the unit operational flexibility. While forms of hydraulic free piston engines in the prior art have achieved good operational flexibility, it would be desirable to provide a hydraulic free piston engine with even greater operational flexibility and energy efficiency.

DETAILED DESCRIPTION OF THE PREFERRED EMBODIMENTS

Disclosed herein is a free-piston type hydraulic internal combustion engine with fully variable electronically controlled hydraulic valve actuation, high pressure electronically controlled fuel injection, and a power train useable therewith. In the description to follow, disclosure of certain aspects of the invention with respect to one embodiment in general includes the possibility of use of those aspects in other embodiments as well.

Figure 1:
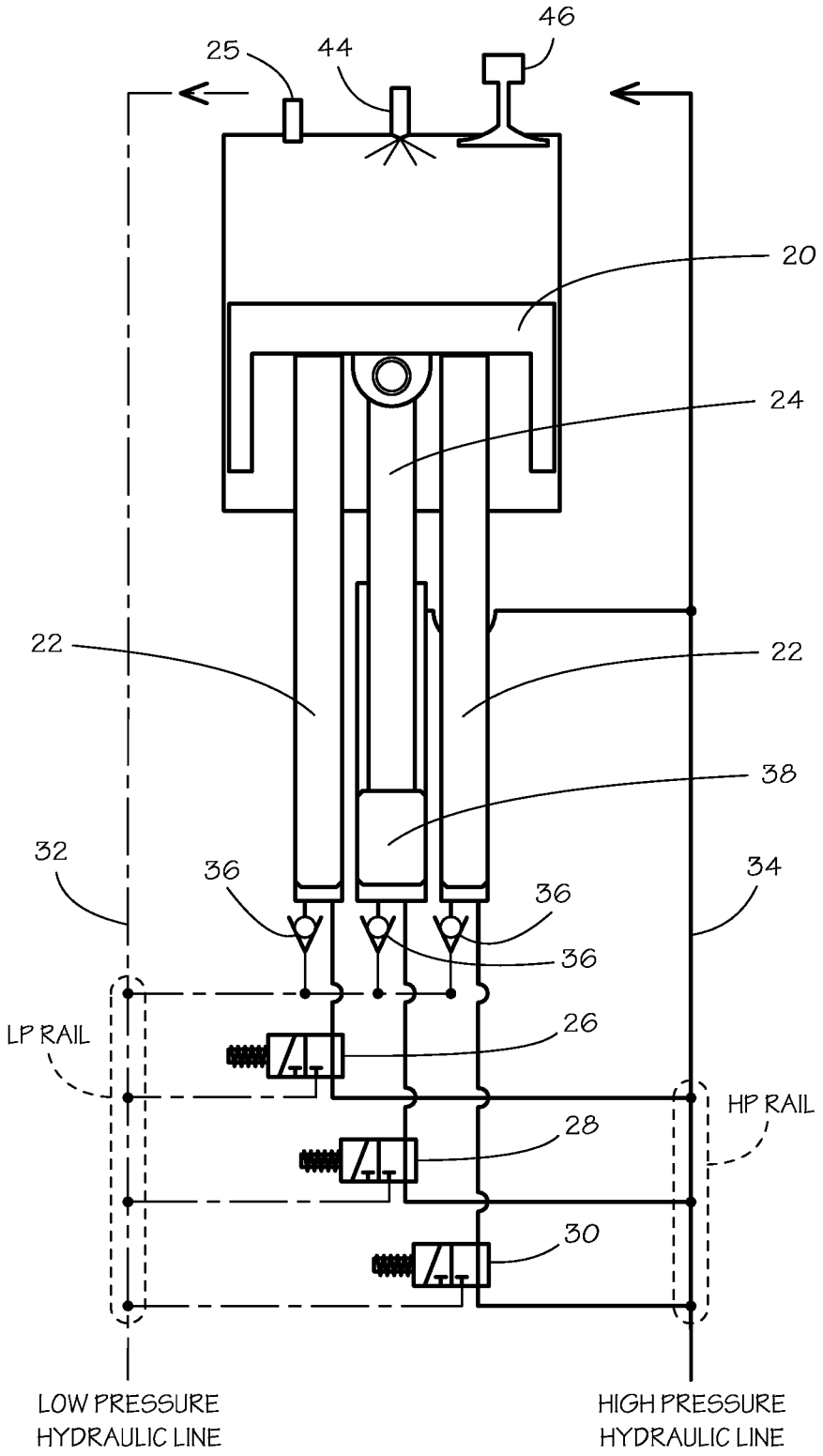
FIG. 1 is as schematic representation of one cylinder of an engine in accordance with the present invention.

One cylinder of an engine in accordance with the present invention is schematically shown in FIG. 1. The two main subassemblies in the engine include the cylinder head assembly and the piston/plunger assembly with hydraulic valves. They are relatively independent of each other and will be described separately.

In this embodiment, the cylinder head assembly incorporates high pressure electronically controlled fuel injectors 44 using intensifier type fuel injectors, and a Hydraulic Valve Actuation system 46 of the general type disclosed in U.S. Pat. No. 6,739,293.

The piston/plunger assembly replaces the piston/connecting rod/crank-shaft assembly of a traditional engine, and converts the chemical energy released during combustion into hydraulic energy. It does this conversion by effectively pumping hydraulic fluid from the low pressure reservoir into the high pressure accumulators with properly timed opening and closing of electrically actuated hydraulic control valves.

The piston/plunger assembly may be described as follows. A piston 20 has a bottom mating surface with hydraulic plungers 22. There are a number of plungers for each piston, at least three, and potentially more, such as by way of example, six plungers 22 equally distributed (see also FIG. 12) around a seventh center plunger 24. The top of the plungers are pushed downward by the bottom surface of piston 20 (note that words like top, bottom, above, below, etc. are used for convenience in a relative sense and not in an absolute sense, and are not to be construed in a limiting sense). At the bottom of the plungers are situated hydraulic volumes. Through electrically actuated three-way hydraulic valves 26, 28 and 30, herein called the plunger valves, each of these volumes is connected either to the low pressure (LP) rail 32, when the plunger valve is in the closed position, or to the high pressure (HP) rail 34, when the plunger valve is in the open position. The plunger volumes may each also be connected to the LP rail through check valves 36 to increase the flow area from the LP rail to the plunger hydraulic volume without increasing the control valve flow area and size.

The return of the piston 20 and plungers 22 and 24 to the bottom position during the intake stroke is facilitated by a hydraulic return arrangement shown in FIG. 1. The hydraulic return is the reason why the center plunger is connected to the piston. At least one plunger, preferably the center plunger 24, must be able to pull on the piston to move it downward during the intake stroke. As shown in FIG. 1, the bottom of the center plunger is larger in diameter than the upper portion, and in this embodiment is coupled to the high pressure rail at all times. This provides a downward force on the center piston when the bottom of the center piston is coupled to the low pressure rail for piston 20 return, such as for an intake stroke, but an upward force when the bottom of the piston 20 is coupled to the high pressure rail by valve 26, such as may be used during a compression stroke or during a power stroke. Also as an alternative, the region above enlarged end 38 of center plunger 24 may be coupled to a control valve so as to be controllably coupled to the high pressure rail or the low pressure rail. Note that in all cases for all plungers, the low pressure rail should be high enough in pressure to backfill the corresponding hydraulic volume as the plungers move away from the respective hydraulic fluid inlet port for the respective plunger.

Using multiple plungers for each engine cylinder allows for matching or balancing the pressure force on top of the pistons with the hydraulic pressure force on the bottom of the plungers through the entire engine cycle, thereby facilitating a controlled piston/plunger velocity at any point of the combustion cycle, which in turn facilitates a high efficiency chemical to hydraulic energy conversion. A pressure sensor 25 may be provided in the combustion chamber to provide an input to a controller that manages the piston/plunger velocity, if desired, though monitoring the hydraulic control valve positions and piston position, and from piston position versus time, the piston velocity and acceleration, provides essentially all information needed.

If six plungers 22 are used in addition to the center plunger 24, two diametrically opposed plungers may be controlled by one valve, say valve 26, and the other four by valve 30. If the center plunger 38 is the same net size as the other six plungers, then by way of example, during a power stroke, seven plungers may be used for pumping hydraulic fluid to the high pressure rail (and a high pressure accumulator), then six (all except the center plunger 24), then five (four plus the center plunger 24), then four (the four plungers controlled by one of the valves), then three (the two plungers controlled by one of the valves plus the center plunger), etc., providing a binary progression to well match the desired piston force to have excellent control over piston position and velocity at all times.

Alternatively, each plunger may have its own control valve, though in such an embodiment, the control valves for diametrically opposed plungers would be operated in unison to avoid a torque in the piston 20 about a horizontal axis. Accordingly, as a further alternative, each valve may control opposing pairs of plungers. Also such embodiments make it easier to obtain the binary progression described above, as the valve switching to obtain the desired result is reduced. Obviously high speed, electronically controlled, electrically actuated valves preferably should be used, also preferably two stage spool valves to provide the flow areas needed.

In the engine of the type shown in FIG. 1, typically multiple cylinders would be used, with each cylinder being the same as that shown in FIG. 1. In such an engine, compression ignition is preferably used as shown, though alternatively, spark ignition may be used if desired, or even as an additional capability in an engine also having compression ignition capabilities, with or without direct fuel injection into the combustion chamber, to allow operating on an even wider range of fuels. Conventional four stroke operating cycles may be used, though two stroke operation is also possible. In that regard, note that the engine may be run at full output, and stopped dead within one cycle, and later restarted at full power, also within one cycle.

Figure 2:
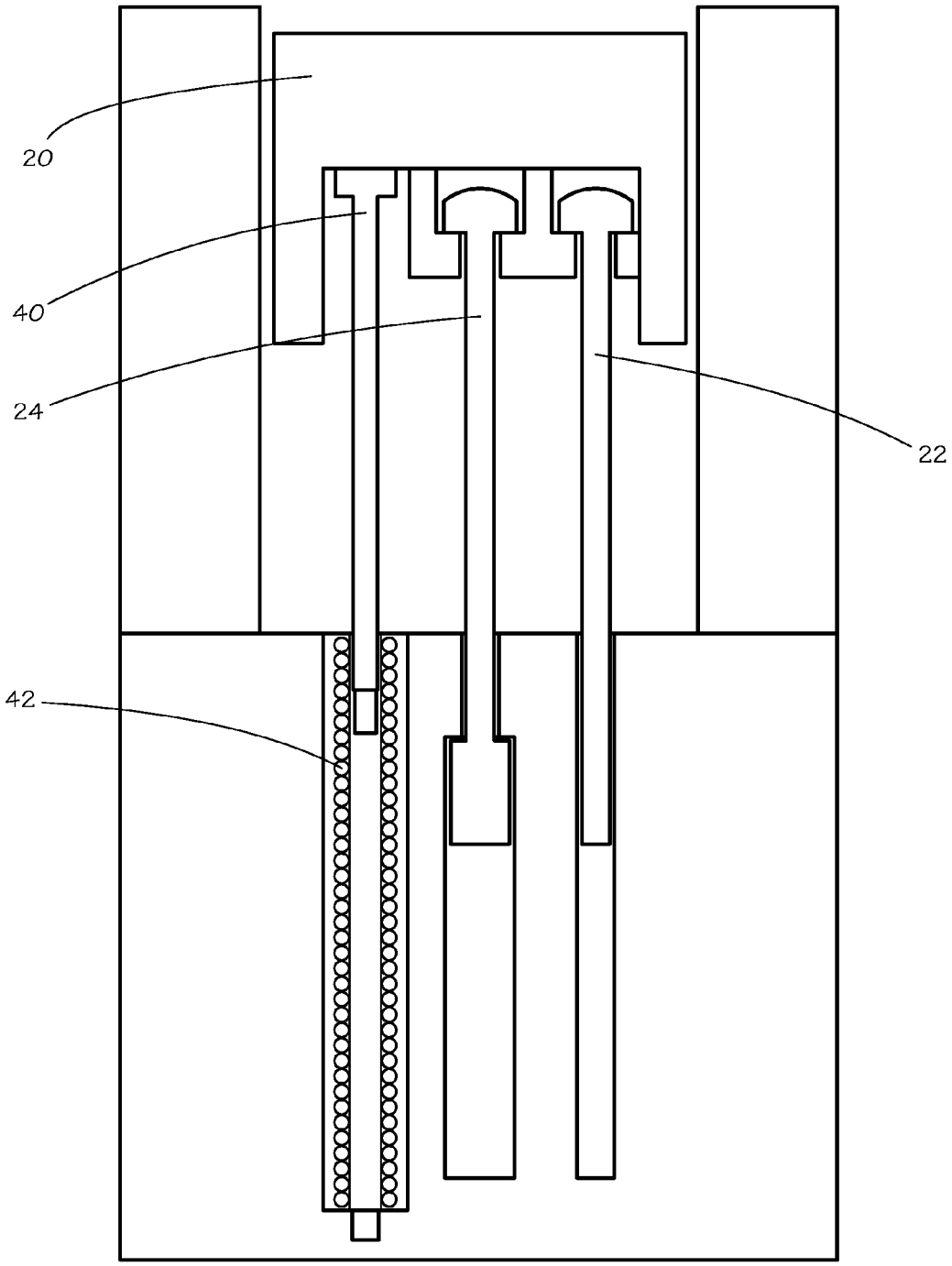
FIG. 2 schematically illustrates a free piston position sensing system that may be used with an embodiment of the present invention.

In a free piston engine, by definition there is no predefined piston position or motion, and in particular, piston velocities and piston extreme positions, as there is for a piston in a crankshaft type engine. Accordingly it is essential to know the position and velocity of a free piston in a free piston engine so that velocity extremes may be avoided and piston extreme positions predefined or at least controlled. Accordingly, FIG. 2 schematically illustrates a free piston position sensing system that may be used for this purpose. In particular, the free piston 20 on a downward motion of a power stroke pumps hydraulic fluid using a variable number of hydraulic pistons to pump to the high pressure rail and accumulator, as hereinbefore described, to control the velocity of the free piston 20. Center hydraulic piston 24, on the other hand, provides a free piston return capability as well as an intake stroke capability as hereinbefore described.

For piston position sensing, however, a magnetic steel plunger 40 is used together with a coil 42 which is excited with a relatively high frequency AC signal. The impedance of the coil will vary with the position of the magnetic plunger 40. While the variation in impedance with plunger position may not be linear and/or the circuitry for sensing the impedance may not be linear, a calibration curve may readily be applied to linearize the output signal with piston position. In that regard, since the free piston engine is processor controlled, the calibration may easily be done in the digital domain by converting the nonlinear signal to a digital signal through an analog-to-digital converter and then linearized by way of a lookup table to provide true piston position in digital form for use by the free piston engine digital controller. Obviously FIG. 2 is a schematic diagram, though illustrates the principles of the free piston position sensor.

Figure 3:
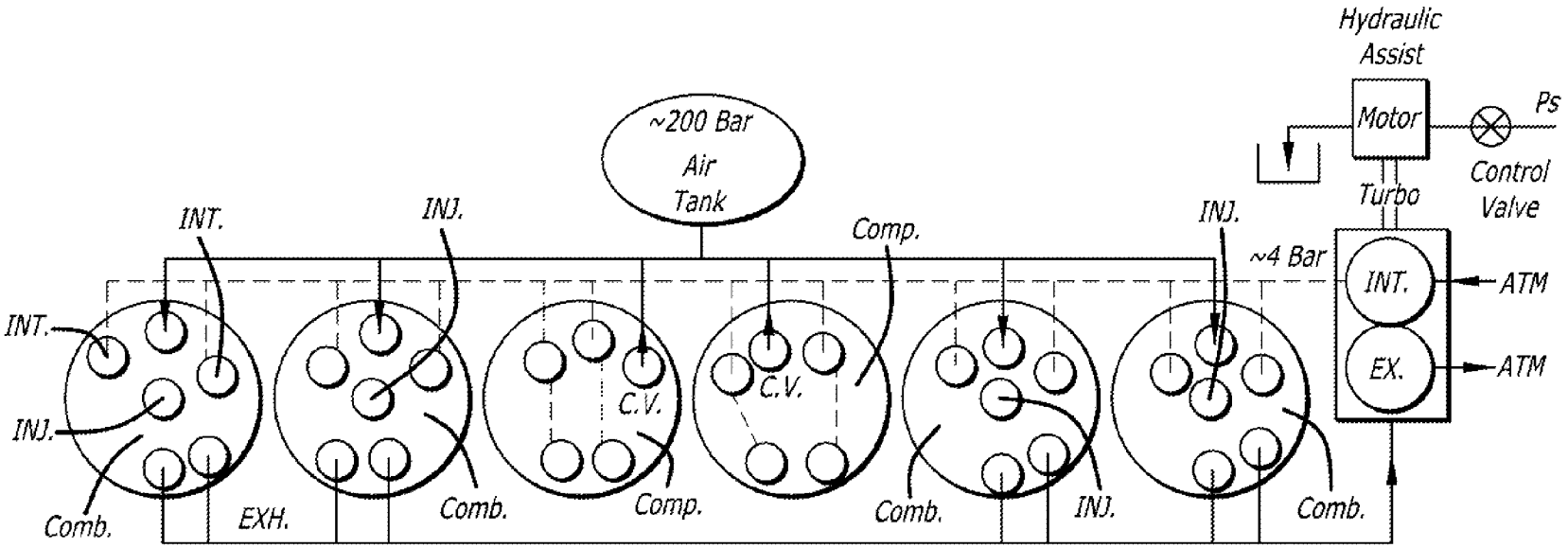
FIG. 3 is a schematic of another possible general implementation of the present invention.

Now referring to FIG. 3, a schematic of another possible general implementation of the present invention may be seen. In this implementation, a six-cylinder engine is shown, with the two center cylinders being used for compression COMP and the two cylinders at each end of the engine being used as combustion cylinders COMB. The exhaust EXH from the combustion cylinder drives a turbocharger TURBO prior to being exhausted to the atmosphere ATM. The turbocharger in this embodiment would increase the intake air INT to a pressure of approximately 4 bar, providing the turbocharged air to the intake valves on all six cylinders. For purposes of engine starting, and whenever else a turbocharger boost is required or beneficial, a hydraulic assist may be provided through a hydraulic motor controlled by a control valve coupled to a source of hydraulic fluid under pressure $P_S$. In the case of the two compression cylinders COMP, what normally might be two intake valves and two exhaust valves for each cylinder may be all used as input valves, with a check valve C.V. in each of the compression cylinders COMP for exhausting compressed air from the compression cylinder COMP through an air rail to an air tank at a pressure of approximately 200 bar.

Alternatively, a positively actuated valve may be used. The pressure in the air tank, of course, may be controlled by controlling the compression piston position at which the intake valves of the compression cylinders COMP are closed, which of course also controls the volume of high pressure air delivered to the air tank. In that regard, note that the compression cylinders COMP always operate in a two-cycle compression mode, whether the combustion cylinders COMP may themselves operate in a two-cycle, four-cycle, six-cycle, or some other mode.

The air from the air tank is injected into each of the combustion chambers COMB through a valve which, in the preferred embodiment, is also hydraulically controlled through an electronic controller, and of course timed and sized, etc., to provide the desired amount and timing of the air injected into the combustion chamber. In that regard, obviously the pressure in the air tank must be higher than the pressure in the combustion chamber at the time of injection of the air, though in the preferred embodiment that is easily achieved by actually monitoring the pressure in the combustion chamber, both as the pressure and as an indication of both ignition and the temperature in the combustion chamber. Note that while a single valve is schematically illustrated in FIG. 3 for injection of air from the air tank, multiple valves may be used.

Preferably the pressure in the air tank will be controlled by control of the intake valves on the compression cylinders COMP to provide a higher pressure than is in the combustion chamber COMB during air injection, but not so much higher as to dissipate unnecessary energy. In that regard, the highest pressure obtainable in the air tank may readily be controlled for the compression cylinders COMP, which by the engine head design may be different from and particularly larger than the compression ratio for the combustion cylinder COMB. The actual pressure in the air tank, as well as the volume of air delivered to the air tank, is readily controllable by control of the intake valves to the compression cylinders. Note that in general, the air in the air tank will be hot because of its substantially adiabatic compression, though in general not much of that energy will be lost, as normally the high pressure air will be used for injection before that heat is lost.

Figure 4:
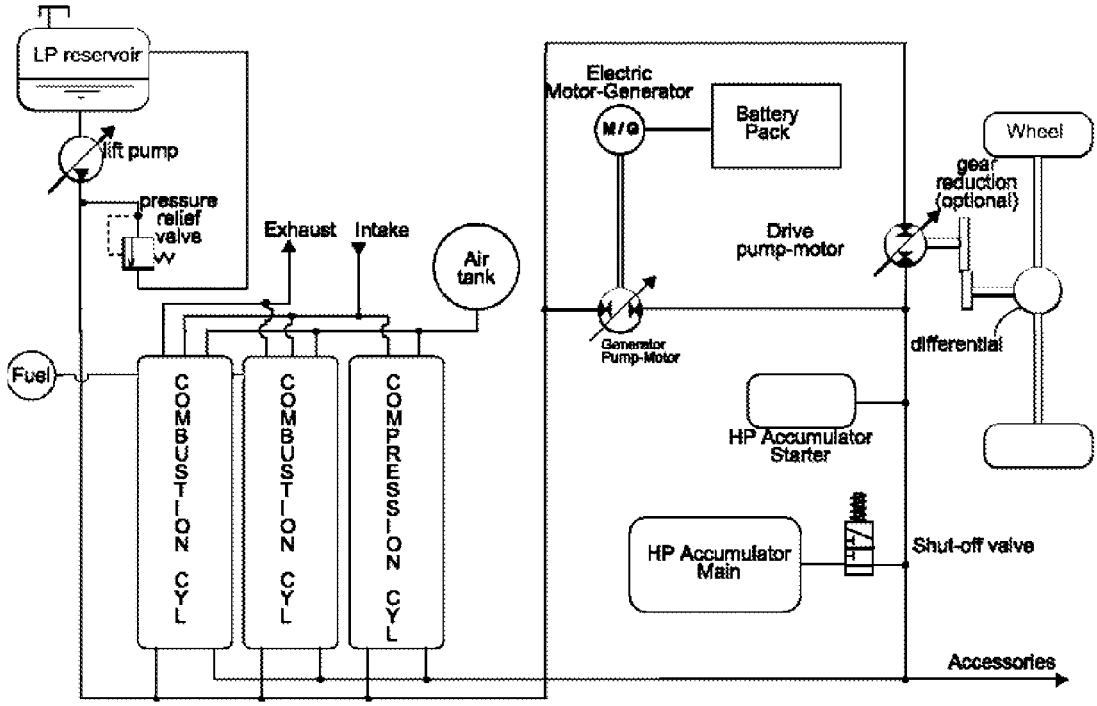
FIG. 4 is a block diagram for an exemplary vehicle power system using the present invention.
Figure 5:
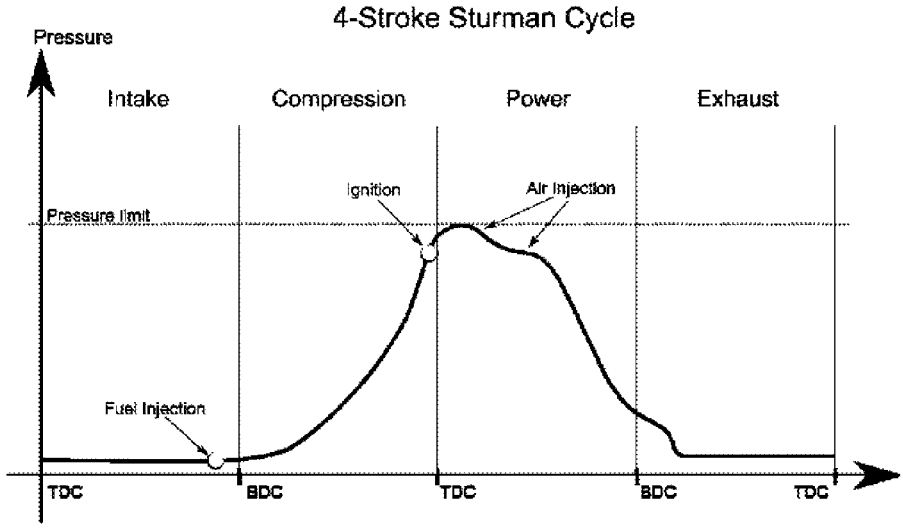
FIG. 5 illustrates a four stroke operating cycle for a free piston engine in accordance with the present invention.

Now referring to FIG. 4, a block diagram for an exemplary vehicle power system using the present invention may be seen. This diagram, as well as the four stroke operating cycle of FIG. 5, are for a free piston engine which may also use, by way of example, any of the operating cycles described in U.S. Pat. No. 6,415,749, U.S. Patent Application Publication Nos. 2007/0245982, 2008/0264393 and 2009/0183699 and U.S. patent application Ser. No. 12/256,296, the disclosures of which are herein incorporated by reference, and may use a variety of fuels including, but not limited to, diesel, biodiesel and ammonia fuels using compression ignition. Another fuel of interest is ethanol. While ethanol is carbon based, it is derived from corn or other plants, and as such, the carbon in ethanol comes from carbon dioxide the plant absorbs, and thus ethanol as a fuel is essentially carbon neutral. Actually even gaseous fuels may be used, either by introduction into the intake manifold of the engine, or even introduced directly into the combustion chamber through a valve provided for that purpose.

The engine shown in FIG. 4, similar to that shown in FIG. 3, uses two combustion cylinders and one compression cylinder, and may operate with the operating cycle illustrated in FIG. 5. The two combustion cylinders are each operating in a four stroke cycle, with the compression cylinder operating in a two stroke cycle. In each of the combustion cylinders and in the compression cylinder, a piston position sensor may be used, such as previously described, though other types of sensors may also be used such as Hall effect sensors, as desired. The piston position sensor used may be a linear sensor or nonlinear sensor, such as sensors designed to have increased sensitivity near the top dead center and bottom dead center piston positions, as higher accuracy at these limits of travel could be beneficial. (The phrases "top dead center" and "bottom dead center" being taken from normal crankshaft type piston engine nomenclature, and in a free piston engine of the type being described, are really simply the top or uppermost position of the piston and the bottom or lowermost position of the piston during operation, which in fact can change cycle to cycle.)

The Air Tank is a high pressure air storage tank providing a buffer for the compression cylinder output to supply air for injection at the appropriate time (an example to be described). Since the combustion cylinders are operating using an exemplary four stroke cycle in this description (see FIG. 5), the combustion cylinders include an intake stroke, a compression stroke, a power stroke and an exhaust stroke, with fuel injection, in the exemplary cycle, all fuel to be injected for the following power stroke occurring during the intake stroke or early in the compression stroke. Injection during the intake stroke assures good fuel air mixing, and may even occur during air intake for best mixing, which may be followed by opening the exhaust valve or valves for some EGR (exhaust gas recirculation). Note however, that the amount of air taken in during the intake stoke is intentionally limited so that on ignition, the fuel rich mixture in the combustion chamber will not reach temperatures at which $NO_X$ is formed, and in the extreme, no air might be taken in, but ignition at the end of the following compression stroke using remaining residual injected air from the prior power stroke.

The air injection occurring during the power stroke after ignition occurs at or near the top dead center position. The amount of air injected after ignition may be substantially equal to, or even somewhat more than, the air ingested during the intake stroke because of the two stroke cycle operation of the compression cylinder in comparison to the four stroke cycle of the combustion cylinders. This, of course, assumes that the compression cylinder and combustion cylinders are operating at the same frequency, which because this is a free piston engine, is not a limitation of the invention, as the compression cylinder may operate at a frequency that is different from the frequency of operation of the combustion cylinders, and for that matter, when no power is required, such as during coasting of the vehicle, all cylinders may stop until power is again needed.

In that regard, note that the pistons may operate with piston velocities corresponding generally to operation of a crankshaft type engine running at, for example, 2400 revolutions per minute, but in fact may pause at some piston position, such as the bottom dead center position for the compression cylinder, and for the combustion cylinder, the top dead center position after an exhaust stroke and prior to the next intake stroke. Thus while the piston velocities can be similar to a crankshaft type engine operating at 2400 RPM, the pause between operation will allow the pistons in the free piston engine to be operating at any lower frequency, essentially down to a dead stop.

Note also that while the compression cylinder and combustion cylinders may operate at independent frequencies, the velocity profiles for the cylinders are not set by the restraints of a crankshaft either, and accordingly, may be tailored for best efficiency. In that regard, the combustion cylinders may use a different piston velocity profile for different strokes, and in fact, the intake, compression, power and exhaust strokes may all be different from each other, and of course, different from the piston velocity profiles used for the compression cylinder.

Fuel for the combustion cylinders is provided through a fuel system, not shown in detail in FIG. 4, for injection, such as by way of an intensifier type fuel injector on each combustion cylinder. The combustion cylinders provide a net high pressure hydraulic fluid through the controllable shut off valve to the main high pressure accumulator. Free piston hydraulic pressure is provided to a low pressure line from the lift pump, and any high pressure hydraulic fluid needed is provided from the high pressure accumulator or high pressure rail. An electrically operated Pressure relief valve may couple the output of the lift pump back to the low pressure reservoir when volume flow (pressure) otherwise would be excessive, with an optional check valve 70 holding the pressure in the low pressure line when the lift pump is not operating.

High pressure hydraulic fluid is also provided to the Drive pump-motor which drives the Wheels of the vehicle, in the embodiment shown, through an optional gear reduction and through a differential of ordinary design. Alternatively, a separate Drive pump-motor may be used for each drive wheel, or alternatively for all wheels of the vehicle, either through appropriate universal joint couplings or by a Drive pump-motor on each wheel.

Not all valving, particularly for the compression cylinder and the three combustion cylinders, is shown in FIG. 4. High pressure hydraulic fluid may also be directed through the Generator Pump-Motor to operate the Electric Motor-Generator to charge the Battery Pack, with the low pressure hydraulic fluid output of the Drive Pump-Motor and the Generator Pump-Motor being returned to the low pressure line. Thus, in normal operation when no high pressure hydraulic fluid is being stored in the main High Pressure Accumulator or the Starter High Pressure Accumulator, the fluid flow through the low pressure hydraulic fluid output of the Drive Pump-Motor and the Generator Pump-Motor being returned to the low pressure line is equal to that needed for replenishing the hydraulic pistons of the Combustion Cylinders, so that the lift pump is not very active. A low pressure accumulator could be incorporated if desired to absorb the pulsing in the low pressure line caused by all three pistons.

The Drive Pump-Motor driving the wheels of the vehicle is preferably reversible, that is, can serve as a bidirectional motor as well as a bidirectional pump to provide regenerative braking for pumping hydraulic fluid into the main High Pressure Accumulator when braking. The Drive Pump-Motor powering the Wheels is preferably a variable pump-motor, such as may be obtained by modulation of the pressure (between high and low pressure) hydraulic fluid supply thereto, with the low pressure output of the Drive Pump-Motor being coupled back to its input between pulses of high pressure hydraulic fluid to its input.

In one mode, the Battery Pack may power the Electric Motor-Generator to turn the Generator-Motor, either for powering the wheels of the vehicle through the Drive Pump-Motor or for charging the High Pressure Accumulator Starter for starting the free piston engine if and when the main High Pressure Accumulator itself is not pressurized. Thus the High Pressure Accumulator Starter is a relatively small accumulator which may be pressurized through the Battery Pack as described with adequate pressure for engine starting purposes, or which may simple store sufficient pressure and volume of high pressure hydraulic fluid for starting purposes. Of course depending on the size of the Battery Pack, the Electric Motor-Generator and the Generator Pump-Motor, the system may be operated as a hybrid with the free piston engine recharging the Battery Pack and powering the vehicle when needed.

In the four stroke cycle illustrated in FIG. 5, fuel injection is shown occurring at or near bottom dead center around the start of the compression stroke, with compression ignition occurring near top dead center. In this exemplary embodiment, all fuel is injected at or near the bottom dead center position at the beginning of the compression stroke or during the intake stroke, with the hot exhaust gasses remaining in the cylinder turning the fuel into a gaseous form and mixing with the same prior to ignition, with or without EGR. At the time of ignition, the amount of oxygen in the respective combustion cylinder is limited so that the pressure rise is limited, and more importantly, the temperature rise is limited, maintaining the temperature below the temperature at which $NO_X$ forms.

After ignition and after top dead center, air is injected as previously explained to sustain combustion and consume all fuel injected to provide an output power for each combustion cylinder approaching that of two cylinders of a conventional crankshaft type piston engine. In that regard, one of the advantages of such a free piston engine is that at or near top dead center, piston movement is not confined by the connecting rod and crank of a crankshaft being aligned with the axis of the piston, and accordingly, the piston is ready to provide output power at the top dead center position and throughout the piston motion to the bottom dead center position.

Of course, any other operating cycle may also be used with the free piston engines of the present invention, including but not limited to those mentioned in the above-referenced patents and applications. In that regard, engines operated in accordance with the foregoing patents and applications provide great flexibility, which flexibility is actually enhanced by the free piston engines of the present invention with electronically controlled fuel injection and hydraulic valve actuation as is known in the prior art, as substantially all operating parameters of such a free piston engine may be varied for the highest operating efficiency.

Also by providing essentially direct hydraulic drive to the drive wheels of the vehicle, elimination of the vehicle transmission (or with a transmission of greatly reduced complexity) and the ability to effectively start and stop the engine in an instant, coupled with regenerative operation, will provide very high efficiency for the overall drive system. Obviously other features or operating methods may also easily be incorporated, such as by way of example, the use of a longer effective power (expansion) stroke than the effective compression stroke. In any event, the ability of the free piston engine to operate with piston speeds, compression ratios, etc. for best efficiency coupled with the ability to pause between cycles, allows operation of the free piston engine with the most efficient operating parameters possible, independent of what would otherwise be the rotation of a crankshaft, and independent of the then needed power output.

Further schematic illustrations of exemplary physical configurations of free piston engines and vehicle drive trains in accordance with the invention will now be shown and described. These configurations are intended for both new vehicles and for retrofit of existing vehicles. In either case it is believed that the most practical introduction of such new technology is by way of use of as much preexisting technology as is practical while still preserving the features and advantages of the new technology. In that regard, one aspect of the present invention that is preserved is the total decoupling of the frequency of operation of the combustion cylinders, with the speed of rotation of the hydraulic motor providing mechanical propulsion (or during coasting or during energy storage during regenerative braking).

Figure 6:
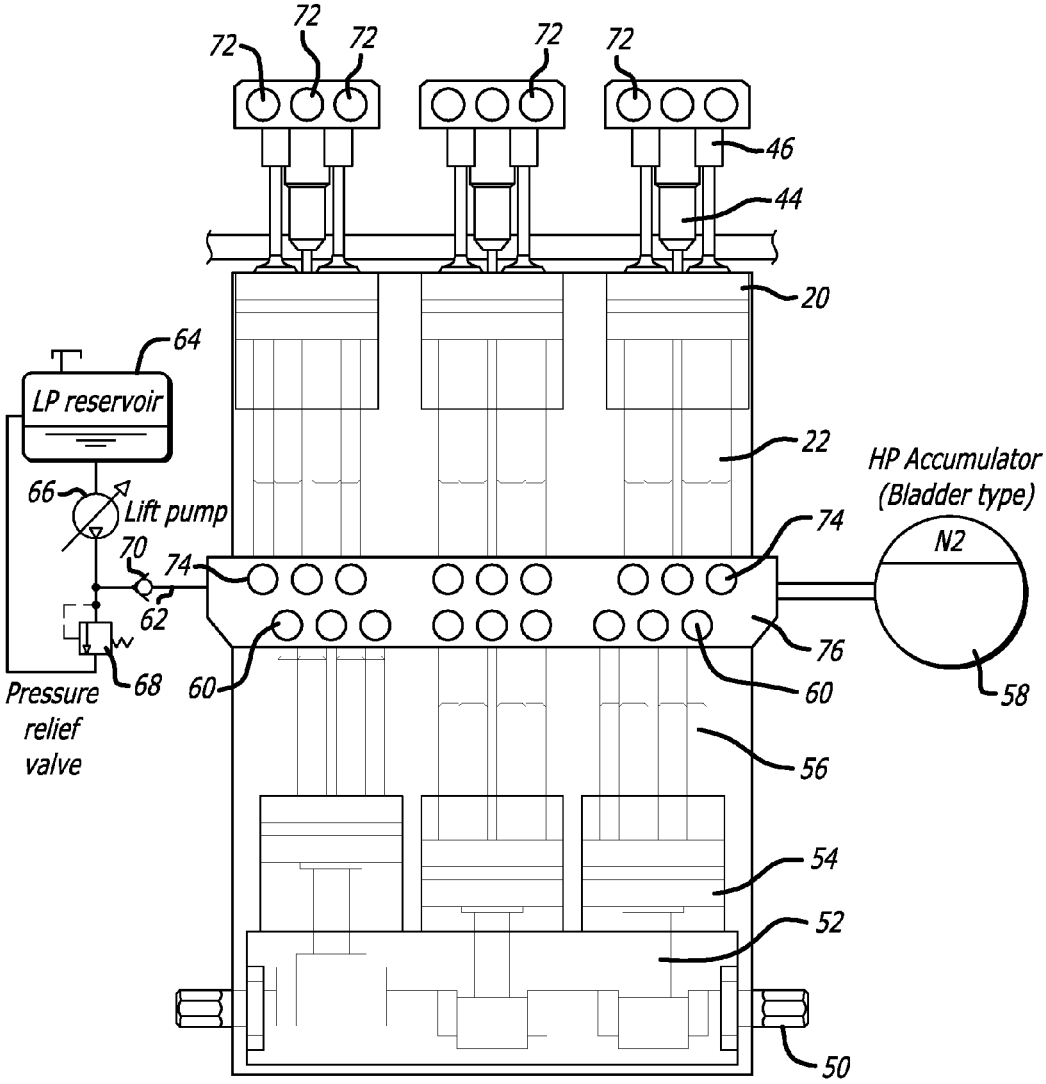
FIG. 6 is a schematic illustration of another exemplary free piston engine/power train in accordance with the present invention.

Now referring to FIG. 6, a schematic illustration of another exemplary free piston engine system may be seen. In this embodiment, all engine cylinders are combustion cylinders. The hydraulic motor for providing mechanical power in this embodiment uses the crankshaft 50 of a conventional piston engine, with connecting rod 52 connecting pistons 54 to the crankshaft 50 in a conventional manner. The pistons 54 may be in accordance with present engine pistons or special replacements for the present engine pistons, as desired or required depending on the conventional piston design.

Hydraulic pistons 56 above pistons 54 are operated from high pressure hydraulic fluid in accumulator 58 in any numerical combination through valves 60 to provide whatever mechanical power is required for the crankshaft's output. Valves 60 may be 2-stage valves, the first stage being electronically (electrically) controllable to each hydraulically control a larger valve for valving high pressure hydraulic fluid from the accumulator 58 to pistons 56 or to a vented or low pressure reservoir, as the mechanical power output requires. The larger valves are hydraulically controlled using the high pressure from a line coupled to the high pressure accumulator. This high pressure hydraulic fluid is also used for hydraulic valve actuation and fuel injection control by electronically controlled valve 72 above the combustion cylinders 20, which in turn are operated or operate hydraulic cylinders 22 through 2-stage electrically controlled hydraulic valves 74, the larger valve of which is also hydraulically controlled by a smaller electronically controlled valve using the low pressure hydraulic fluid in line 62.

Thus in the embodiment shown in FIG. 6, a control valve/manifold assembly 76 may be bolted to the block of a conventional piston engine block assembly with the free piston hydraulic engine assembly thereabove. The free piston engine may be operated in a conventional compression ignition cycle using diesel, bio-diesel or other conventional or unconventional compression ignition fuel. One fuel that is of interest in such an engine is ammonia ($NH_3$) as a carbon free fuel. The present invention operating on cycles that do not require any valves to be open or fuel injection to occur at top dead center piston position allows piston movement to very high compression ratios because of prior injection of fuel, allowing compression ignition of ammonia for very efficient energy conversion to hydraulic energy. In the engine shown, all cylinders are the same, though this is not a limitation of this embodiment.

The schematic diagram of FIG. 6 makes the overall assembly appear relatively tall. However, given the height of conventional engines due to overhead valves and valve drive systems, by careful packaging of the assembly shown in FIG. 6, the free piston engine system of FIG. 6 may have an overall height approximating that of a conventional compression ignition engine. Such an engine may use a conventional or even presently existing engine block, with a conversion to free piston engine essentially being a bolt-on type conversion. As a retrofit, one might replace the clutch with a transmission shaft fastened directly to the end of the crankshaft, or alternatively, leave the clutch in place though remove the clutch pedal, as a free piston engine such as shown in FIG. 6 may provide or recover energy right down to zero crankshaft speed of rotation so that no clutch is needed, as generally no gear shifting is needed, even for reverse, and the crankshaft may be hydraulically driven in either direction by proper control of the hydraulic valving controlling hydraulic pressure over the hydraulic motor plungers.

Figure 7:
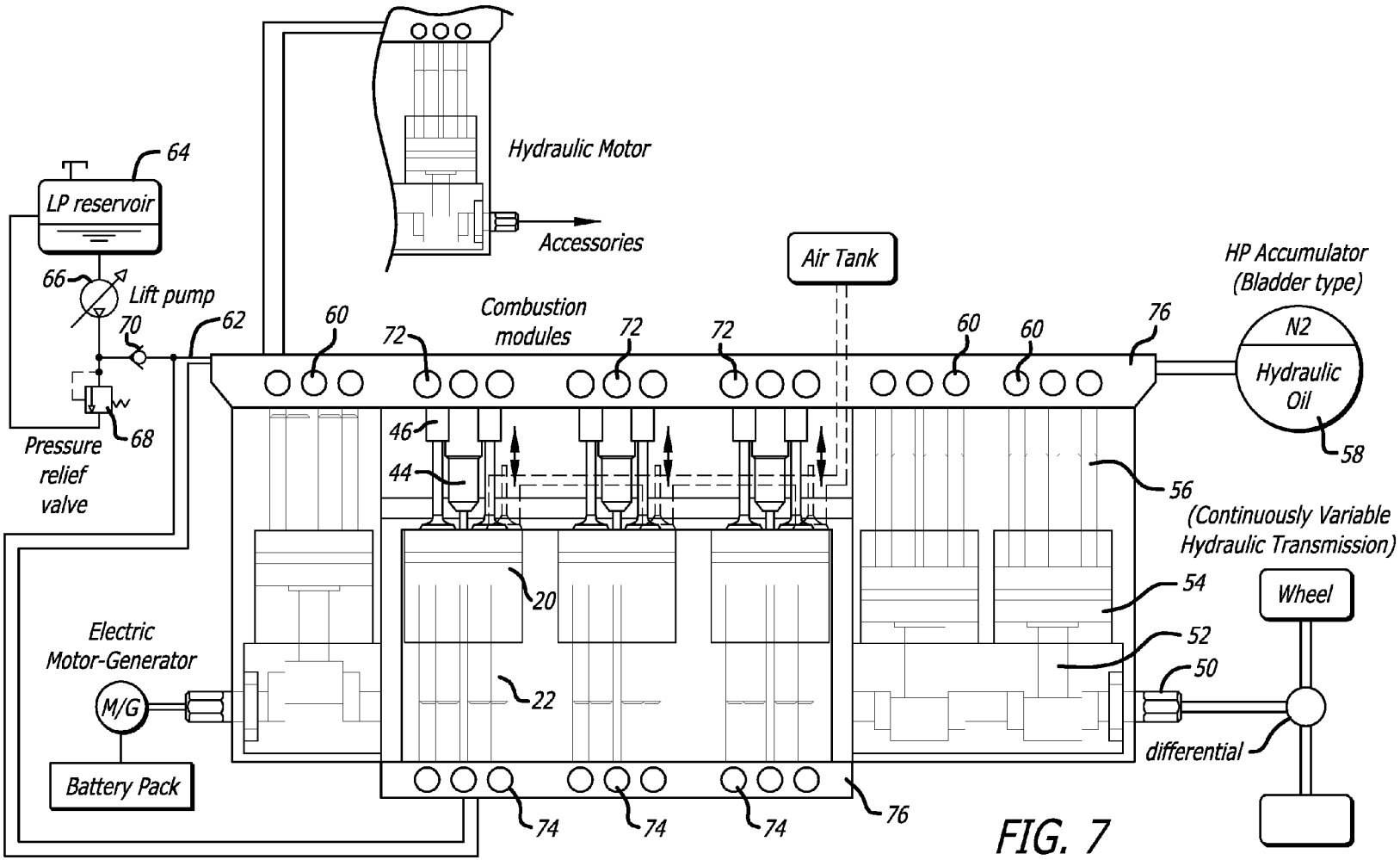
FIG. 7 is a schematic illustration of still another exemplary free piston engine/power train in accordance with the present invention.

If in fact, overall height of the engine is a problem, the present invention may be packaged as shown in FIG. 7, wherein three cylinders of a six cylinder engine are used as free piston combustion cylinders for generating hydraulic energy, and three cylinders are used as a hydraulic motor to convert the hydraulic energy to mechanical work, two turning the wheels of a vehicle, or through a fixed gear reduction or a two or more speed transmission or rear end, and one driving accessories. As before, the speed of operation of the free piston engine portion is totally decoupled from the speed of operation of the hydraulic motor section, either of which is operable down to zero speed, with the hydraulic motor portion being able to recover vehicle kinetic energy when used for energy recovery during "braking".

Figure 8:
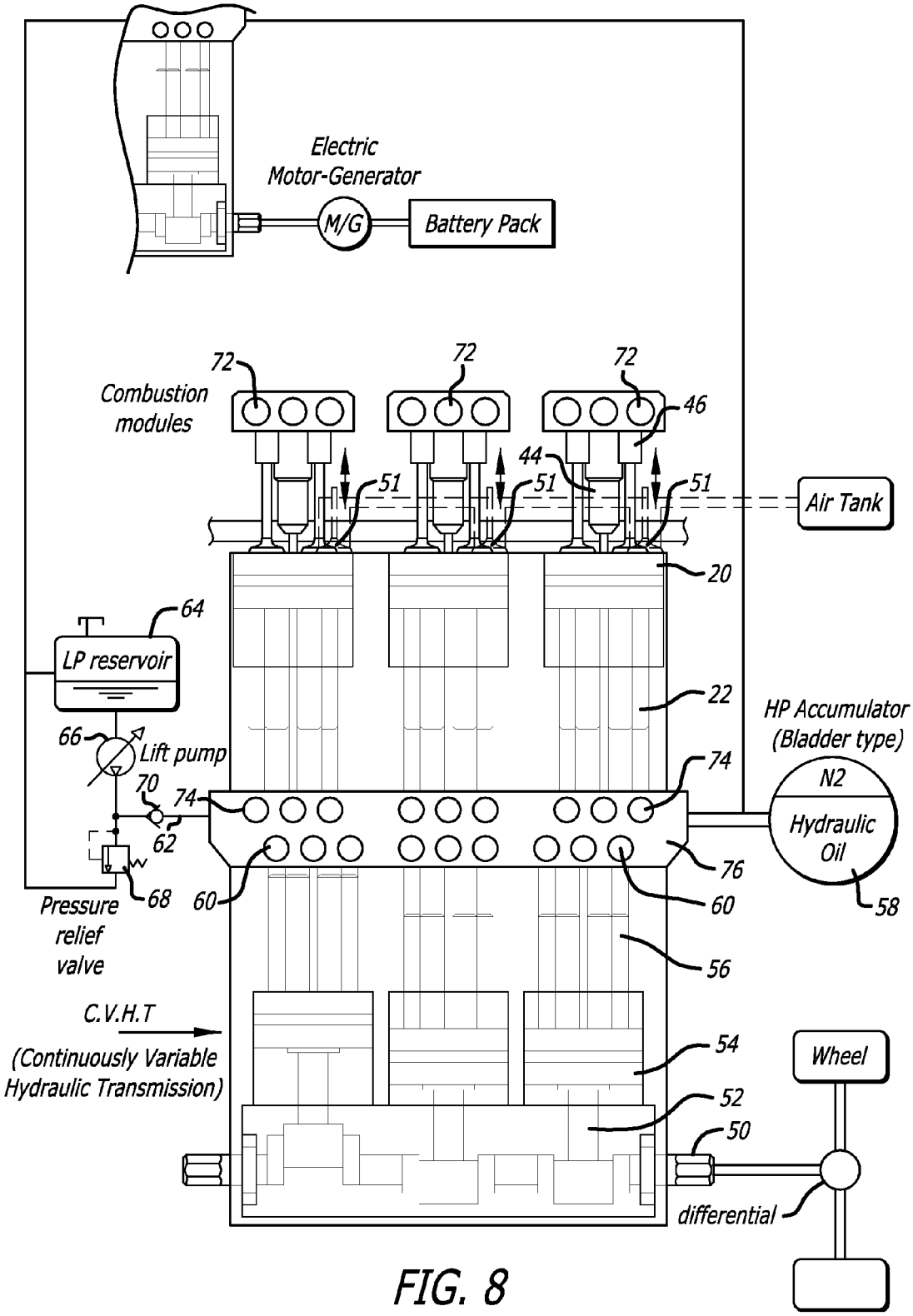
FIG. 8 shows the Electric Motor-Generator of FIG. 4 in more of a physical realization.

FIG. 8 shows the Electric Motor-Generator of FIG. 4 in more of a physical realization. Also, FIG. 8 illustrates the inclusion of an air storage tank and at least one additional electronically controlled valve 51 in each of the combustion cylinders, which allows the operation of any of the combustion cylinders as an air compressor for storing high pressure air in the air tank as well as using air injection into any cylinder being used for a combustion cylinder to sustain combustion throughout a greater motion of the free piston during its power stroke. This allows the use of some cylinders as compression cylinders and some other cylinders as combustion cylinders at any one time using operating cycles such as are described in the heretofore referred to patent and patent applications. Again, if height of the engine is a problem, an engine of the type shown in FIG. 8 may be packaged as shown in FIG. 7.

Thus in the embodiments of FIGS. 3, 4 and 8, air compression for injection into the combustion chamber of a cylinder is provided, while in the embodiments of FIGS. 6 and 7, no air injection is provided for, so more conventional operating cycles are used.

Figure 9:
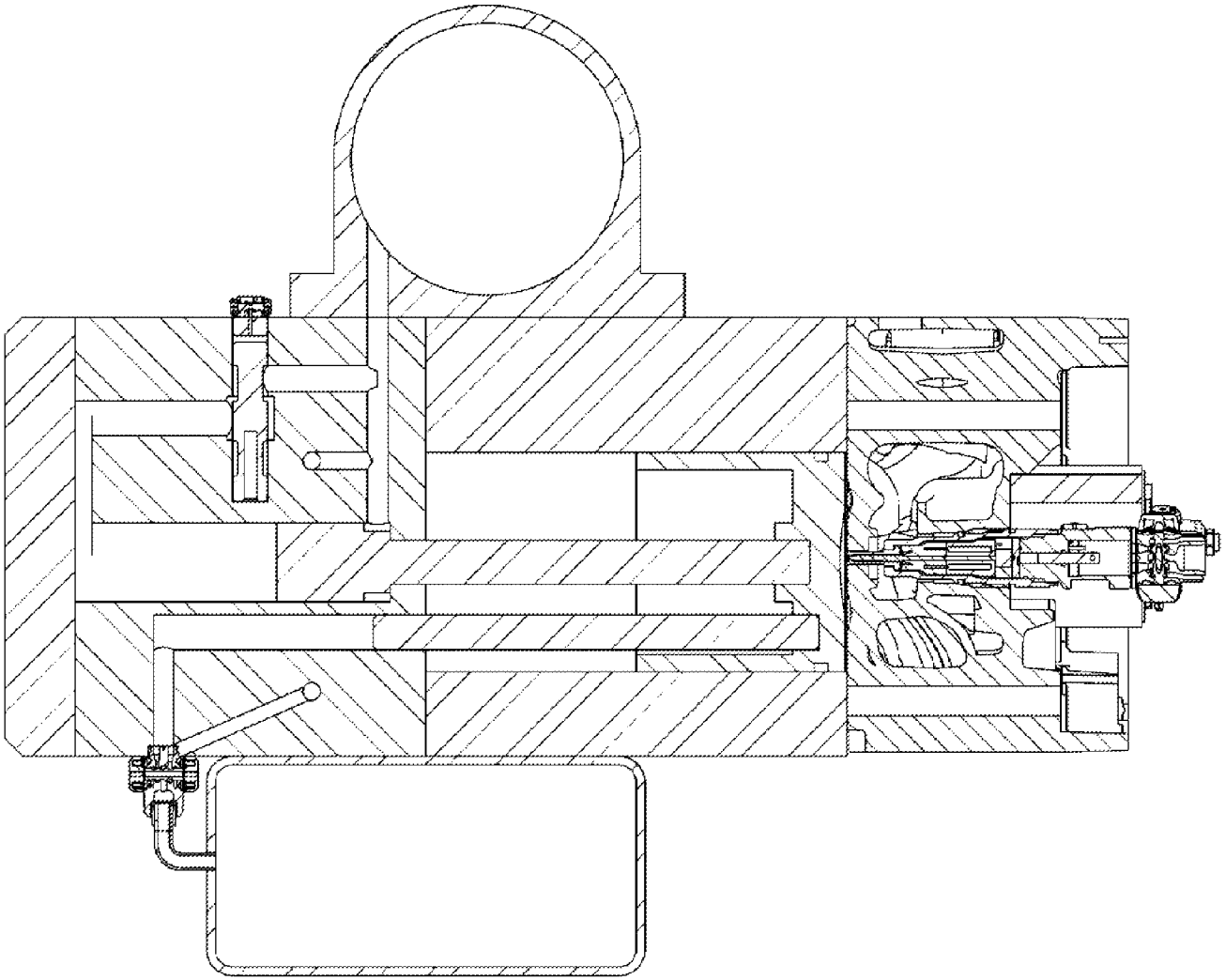
FIG. 9 is a cross-section of an engine that embodies the invention.

FIG. 9 shows a section view of an internal combustion engine that embodies the invention. This figure shows how the reservoirs and accumulators for the hydraulic fluid may be incorporated with the other engine structures.

Figure 10:
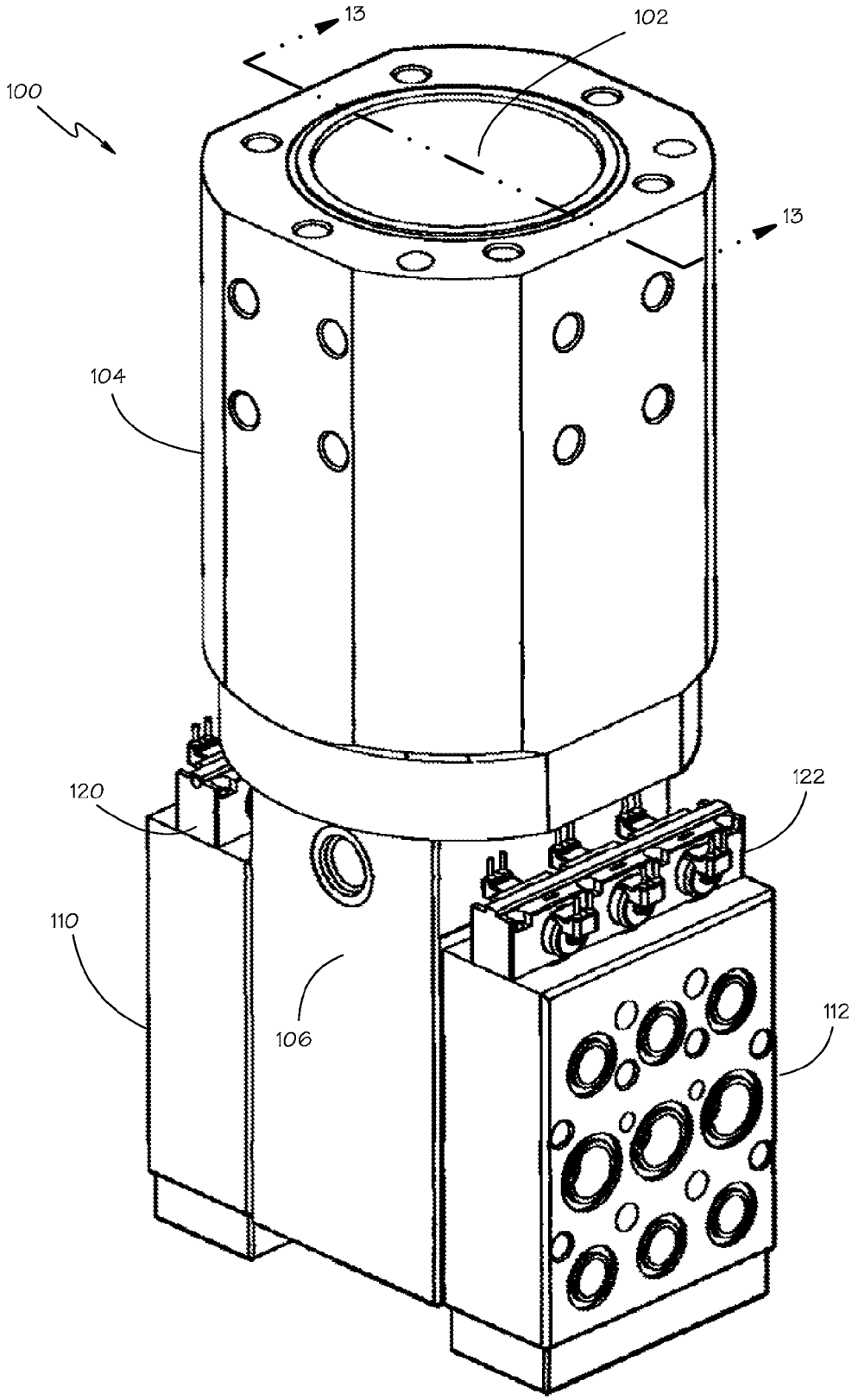
FIG. 10 is a pictorial view of a combustion cylinder and hydraulic assembly that embodies the invention.

FIG. 10 shows a pictorial view of a portion of an internal combustion engine 100 that embodies the invention. The engine 100 includes a combustion cylinder block 104 having a combustion piston 102 that slides within a combustion cylinder in the cylinder block. A complete engine would include a cylinder head coupled to the upper end of the combustion cylinder block 104 to provide intake and exhaust valves and possibly such parts as a fuel injector and/or a spark plug. In that regard, injector 44 in FIG. 1, as well as the injectors shown in other Figures, can be considered to instead be schematic representations of spark plugs for ignition of a fuel air mixture. While compression ignition is preferred because of the greater efficiency associated with the higher compression ratio used, spark ignition could be used if desired. By way of example, for a fuel like ammonia, it is normally difficult to obtain compression ignition unless an engine like the present invention is used where compression ratios obtainable can be very high and controllable, and spark ignition is also somewhat difficult at conventional compression ratios of crankshaft type engines because of the narrow range of fuel air ratios that will spark ignite. However, using the present invention, higher compression ratios may be used than conventional crankshaft engines, which should widely broaden the fuel air ratios that will spark ignite at the higher compression temperatures (i.e., reduce the heat release requirements to maintain combustion), thereby allowing the use of operating cycles such as that shown in FIG. 5, wherein the higher compression ratios obtainable will allow the injection or carburetion of ammonia to form a highly fuel rich air fuel ratio into the combustion chamber which is sufficiently close to the compression ignition temperature to be ignited with a spark plug, with air being injected during the power stroke to maintain the combustion until all ammonia in the initially highly fuel rich charge is consumed.

A hydraulic plunger block 106 is coupled to the combustion cylinder block 104. The hydraulic plunger block 106 includes a plurality of hydraulic plungers coupled to the combustion piston 102 as further described below. A plurality of hydraulic control valves 110, 112, 120, 122 are coupled to the hydraulic plungers as further described below.

Figure 11:
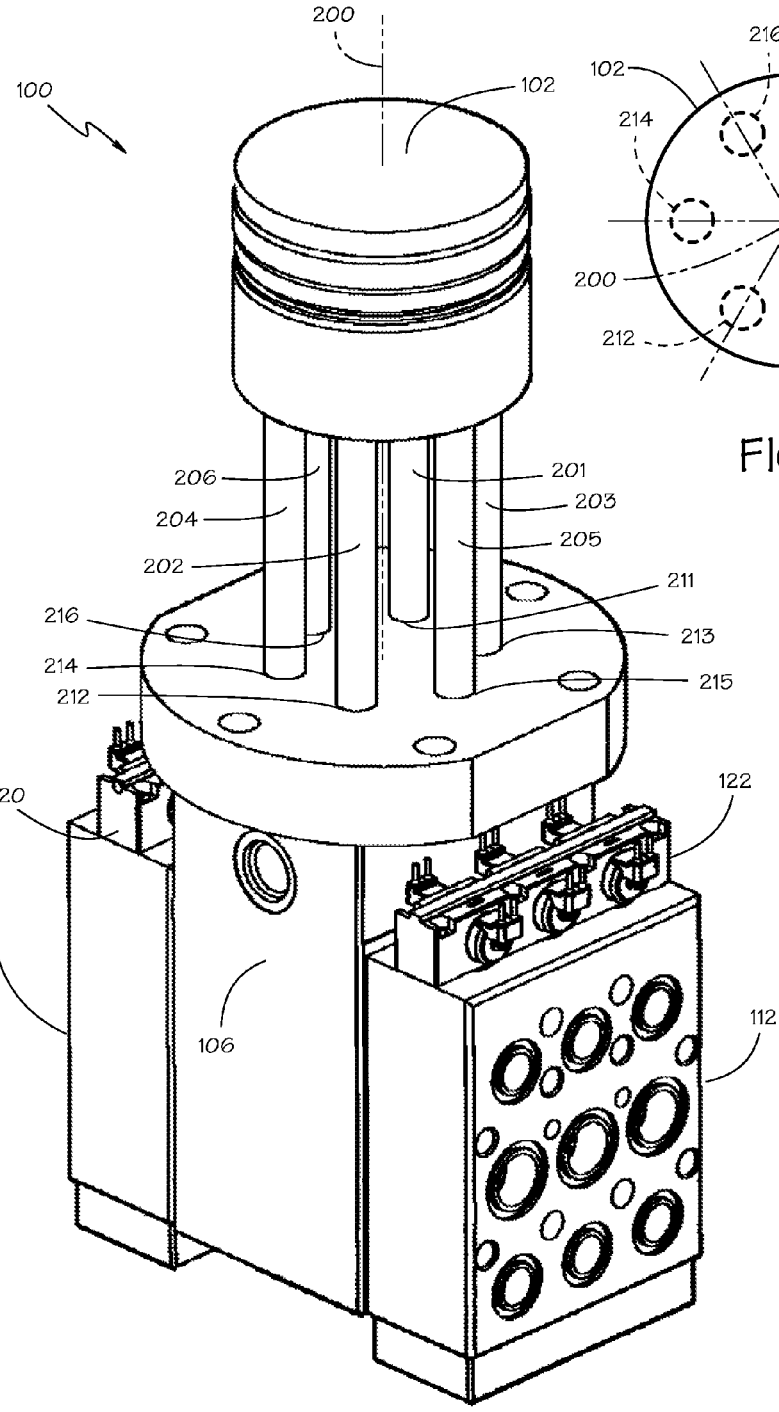
FIG. 11 is a pictorial view of the device of FIG. 10 with the combustion cylinder removed to show the combustion piston.

FIG. 11 shows a pictorial view of a portion of the internal combustion engine 100 with the combustion cylinder block removed to allow additional details of the engine to be seen. In the embodiment shown, the combustion piston 102 is coupled to six hydraulic plungers 201, 202, 203, 204, 205, 206. The six hydraulic plungers slide into six corresponding hydraulic cylinders 211, 212, 213, 214, 215, 216 in the hydraulic plunger block 106. The combustion piston 102 slides within the combustion cylinder along a central axis 200, which is the axis of symmetry for the combustion cylinder.

Figure 12:
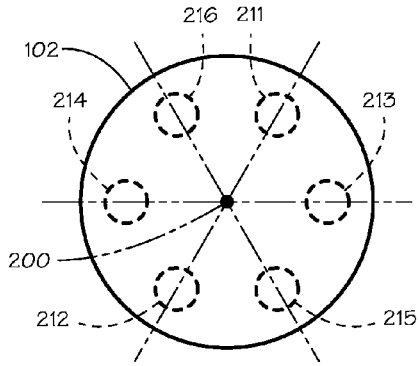
FIG. 12 is a plan view of the combustion piston and hydraulic plungers in the device of FIG. 10.

FIG. 12 is a plan view showing the combustion piston 102 and the six hydraulic cylinders 211-216. It will be seen that the hydraulic cylinders are arranged in pairs 211-212, 213-214, 215-216. Each pair of hydraulic cylinders is located on a diameter of the combustion cylinder as suggested by the broken lines that pass through the central axis 200 of the combustion cylinder. Each hydraulic cylinder in a pair has substantially the same diameter and is located the same distance from the central axis 200. This allows the combustion piston 102 to be supported by two hydraulic plungers in one of the pairs of hydraulic cylinders without creating a rotational moment on the combustion piston 102.

Figure 13:
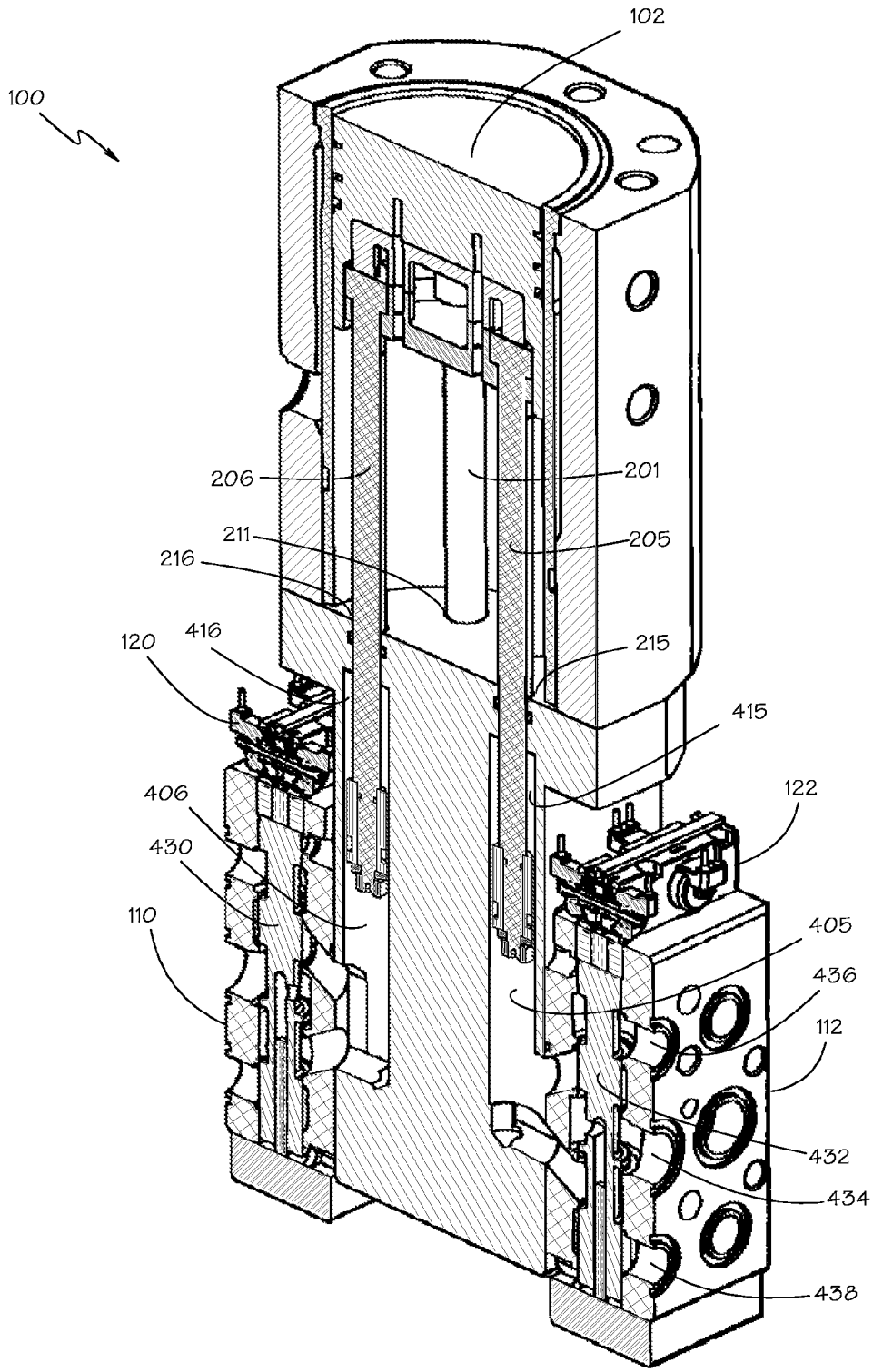
FIG. 13 is a section view of the device of FIG. 10 taken along section line 13-13.

FIG. 13 is a sectioned view of the internal combustion engine 100 that allows further details of the engine to be seen. In the embodiment shown, the hydraulic control valves include an electrically operated pilot valve 120, 122 that controls a spool-type 3-way valve 110, 112. In the embodiment shown, three hydraulic control valves share a common body. The pilot valves in one embodiment are spool valves of the general type shown in U.S. Pat. No. 5,640,987, though non-latching and spring return valves, preferably but not necessarily spool valves, may be used as desired.

As seen in the right-hand sectioned valve, the spool 432 connects the lower end of the hydraulic cylinder 405 to either a single connection 434 or a pair of connections 436, 438. One of the connections is connected to a high-pressure hydraulic line and the other is connected to a low-pressure hydraulic line. It is significant that each of the hydraulic valves is controlled independently of the remaining hydraulic valves. This provides substantial flexibility in the operation of the engine.

As previously stated, each two stage valve controllably couples the end of a respective hydraulic cylinder to the high-pressure hydraulic line or the low-pressure hydraulic line. Spool valves have certain advantages in such use, in that they require minimal motion of the spool to provide a maximum flow area. Also, spool valves can be designed to make before break or make after break, so to speak. That is, three-way spool valves can be designed to shut off flow from port A to port B before opening a flow path from port A to port C. In a system like the present invention, this could be quite troublesome, in that a momentary hydraulic lock would result, causing substantial energy loss. On the other hand, opening a flow path from port A to port C before shutting off flow from port A to port B provides a momentary direct flow path from the high pressure hydraulic line to the low pressure hydraulic line, also possibly causing a substantial energy loss. In the present invention, these effects are minimized in part by the speed of the valves, in part by the compressibility of the hydraulic fluid, and most importantly, by the design of the second stage spool valve to operate at the most efficient compromise between these two considerations.

The two plungers 205, 206 shown in section include an enlarged lower portion which creates an upper hydraulic volume 415, 416 that can be pressurized to drive the combustion piston 102 toward bottom dead center. The upper hydraulic volume 415, 416 may be continuously connected to the high pressure supply since the larger active surface of the lower hydraulic volume 405, 406 will create a net upward force when high pressure is connected to the lower hydraulic volume.

It may be noted that the hydraulic plungers 205, 206 are coupled to the combustion piston 102 with a connection that provides a small amount of play. This play accommodates slight misalignments between the combustion piston 102 and the hydraulic cylinders 211-216.

Figure 14:
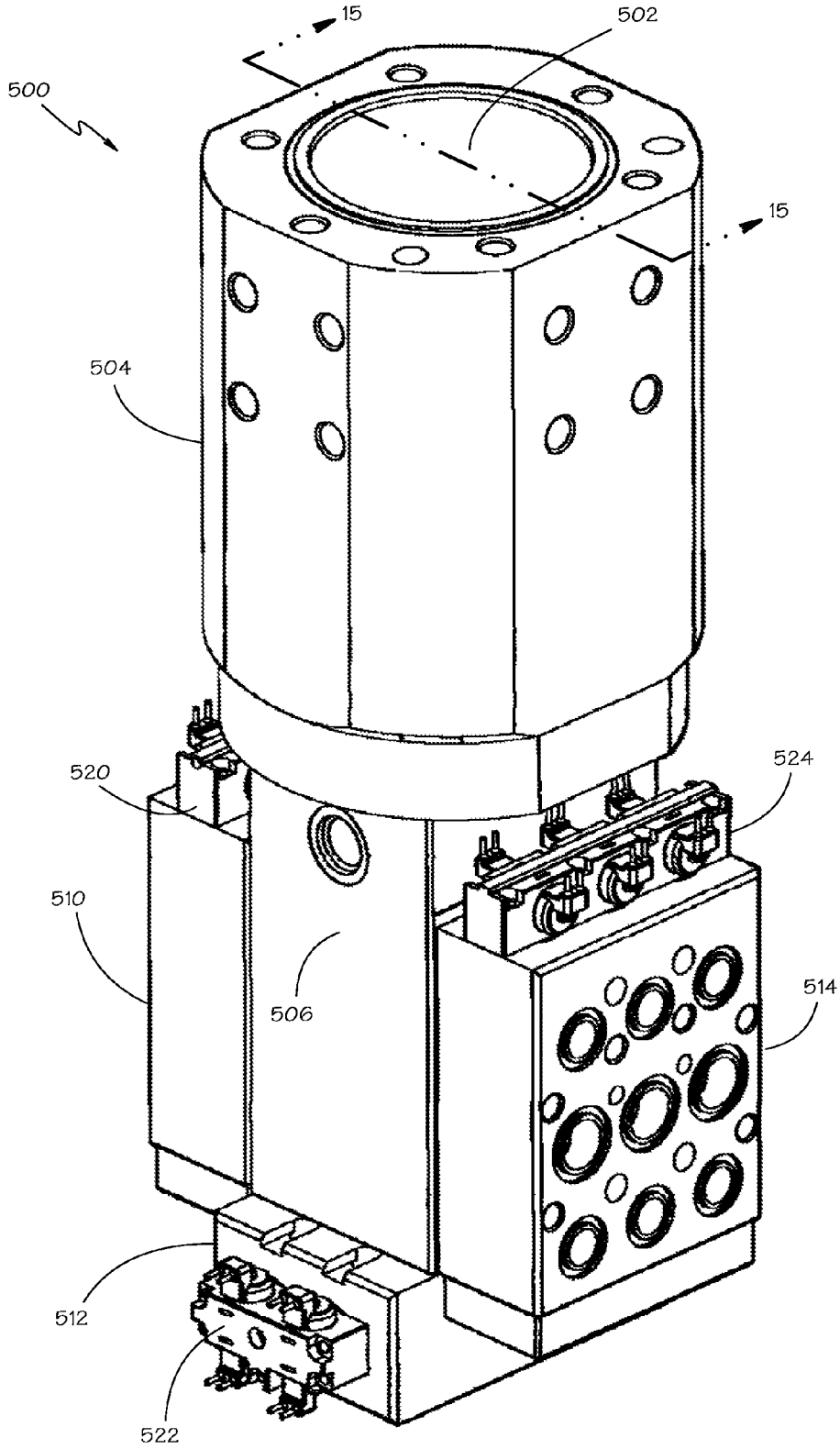
FIG. 14 is a pictorial view of another combustion cylinder and hydraulic assembly that embodies the invention.

FIG. 14 shows a pictorial view of a portion of an internal combustion engine 500 in another embodiment of the invention. The engine 500 includes a combustion cylinder block 504 having a combustion piston 502 that slides within a combustion cylinder in the cylinder block. A complete engine would include a cylinder head coupled to the upper end of the combustion cylinder block 504 to provide intake and exhaust valves and possibly such parts as a fuel injector and/or a spark plug.

A hydraulic plunger block 506 is coupled to the combustion cylinder block 504. The hydraulic plunger block 506 includes a plurality of hydraulic plungers coupled to the combustion piston 502 as further described below. A plurality of hydraulic control valves 510, 512, 514, 520, 522, 524 are coupled to the hydraulic plungers as further described below.

Figure 15:
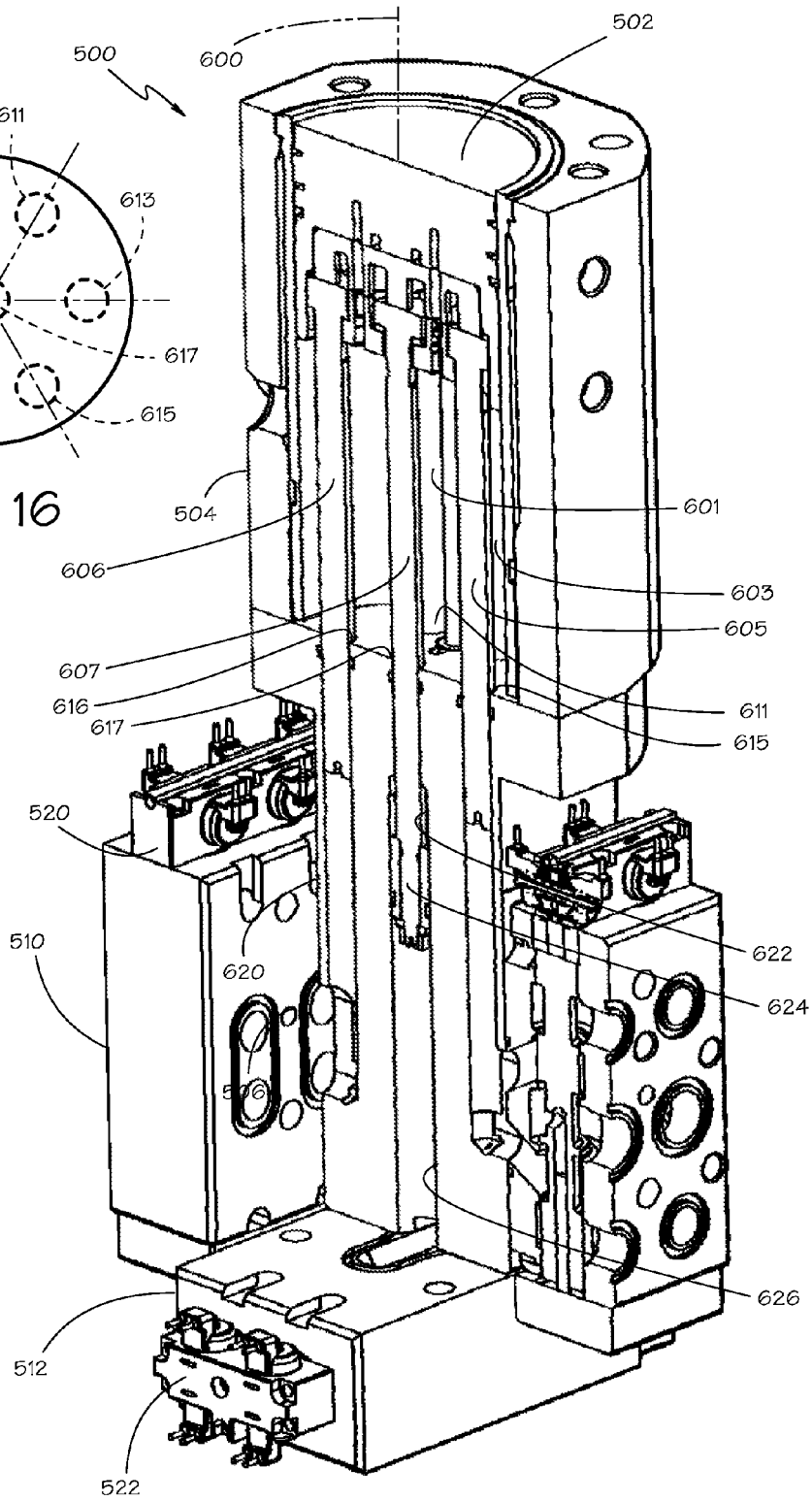
FIG. 15 is a section view of the device of FIG. 14 taken along section line 15-15.

FIG. 15 is a sectioned view of the internal combustion engine 500 that allows further details of the engine to be seen. In this embodiment there is additional hydraulic plunger 607 that slides into a single hydraulic cylinder 617 located along the central axis 600 of the combustion cylinder. Additional hydraulic control valves 512, 522 are provided to connect this additional hydraulic cylinder to high-pressure and low-pressure hydraulic lines. Forces may be applied between the combustion piston 502 and the single hydraulic plungers 607 without creating a rotational moment on the combustion piston because the single hydraulic plunger 607 is located along the central axis 600 of the combustion cylinder. In other respects this embodiment is like the embodiment described above.

The single hydraulic cylinder 617 is enlarged in its lower portion. The lower end 624 of the hydraulic plunger is similarly enlarged. This creates two opposing hydraulic control surfaces so that the single hydraulic plunger 607 can either push or pull the combustion piston 502. High-pressure hydraulic fluid can be introduced into the hydraulic cylinder 626 below the hydraulic plunger to push the combustion piston 502 in an upward direction or to resist a downward movement of the combustion piston during a combustion cycle. High-pressure hydraulic fluid can be introduced into the hydraulic cylinder 622 above the enlarged portion 624 of the hydraulic plunger to pull the combustion piston 502 in a downward direction during an intake cycle.

In some embodiments the high-pressure hydraulic fluid is continuously supplied to the hydraulic cylinders 622 above the enlarged portion of the hydraulic plunger. The hydraulic plunger 607 will pull the combustion piston 502 in a downward direction when low-pressure hydraulic fluid is introduced into the hydraulic cylinder 626 below the hydraulic plunger because the high-pressure hydraulic fluid acting on the upper portion of the hydraulic plunger creates a larger force in the downward direction than the low-pressure hydraulic fluid acting on the lower portion of the hydraulic plunger creates in the upward direction. Therefore there is a net downward force. When high-pressure hydraulic fluid is supplied to both the upper and lower portions of the hydraulic plunger there is a net force in the upward direction because of the greater area on the lower portion of the hydraulic plunger. In other embodiments two three-way valves are used to switch both the upper and lower portions of the hydraulic plunger between high-pressure and low-pressure hydraulic fluid.

Figure 16:
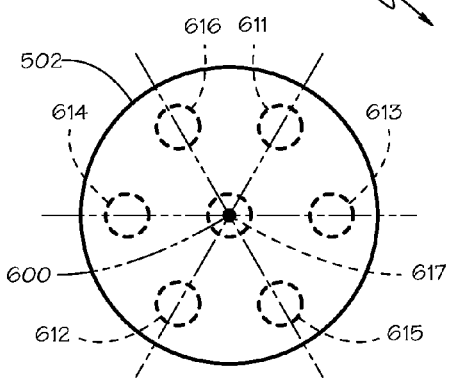
FIG. 16 is a plan view of the combustion piston and hydraulic plungers in the device of FIG. 14.

FIG. 16 is a plan view showing the combustion piston 502 and the seven hydraulic cylinders 611-617. It will be seen that six of the hydraulic cylinders are arranged in pairs 611-612, 613-614, 615-616. Each pair of hydraulic cylinders is located on a diameter of the combustion cylinder as suggested by the broken lines that pass through the central axis 600 of the combustion cylinder. Each hydraulic cylinder in a pair has substantially the same diameter and is located the same distance from the central axis 600. This allows the combustion piston 502 to be supported by two hydraulic plungers in one of the pairs of hydraulic cylinders without creating a rotational moment on the combustion piston 502. The combustion piston 502 may also be supported by the single centrally located hydraulic plunger 617 without creating a rotational moment on the combustion piston 502 as described above.

Figure 17:
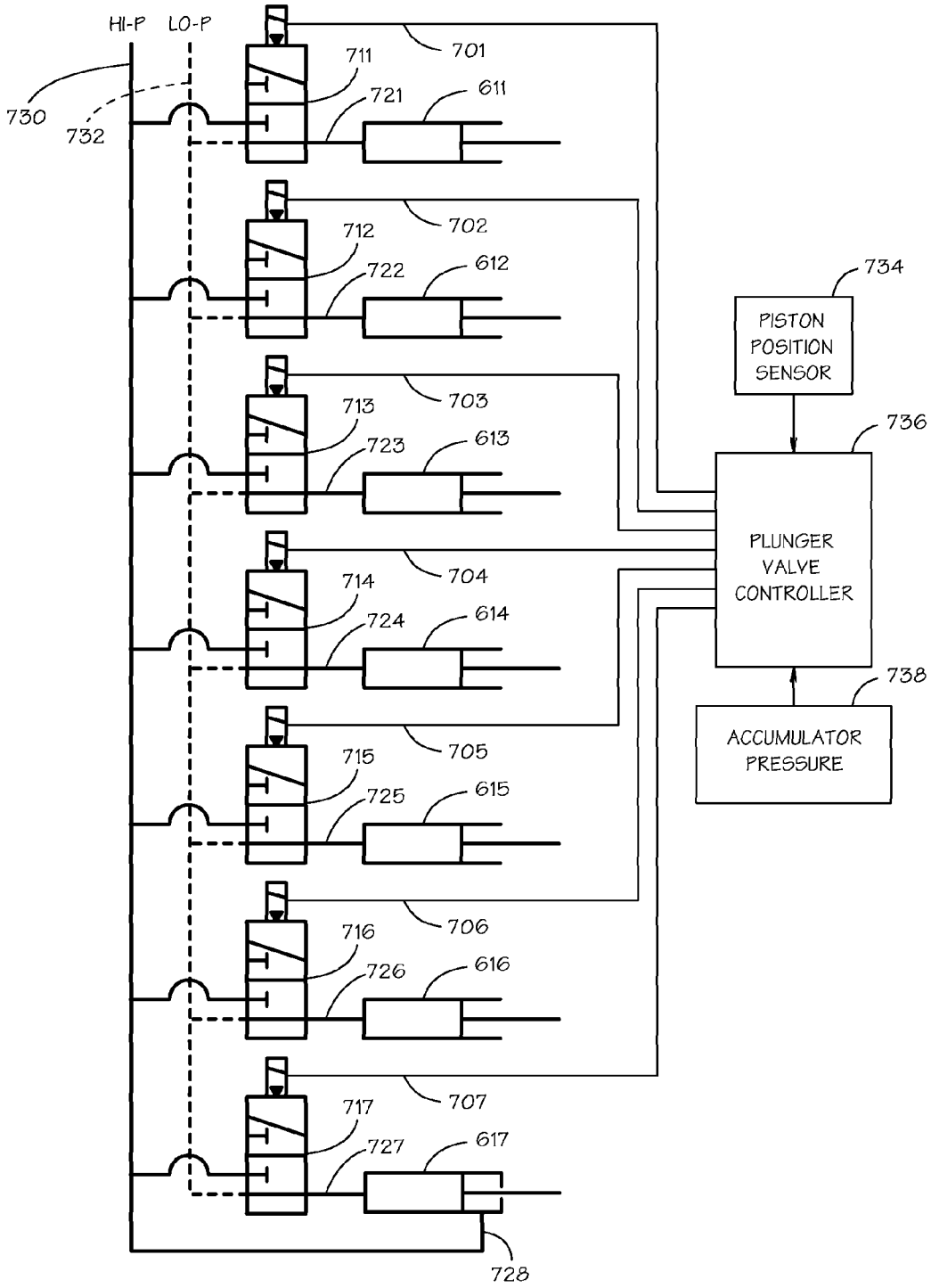
FIG. 17 is a schematic diagram of the valves and control system that may be used in accordance with the present invention.

FIG. 17 is a schematic view of the hydraulic plungers 611-617, their associated electrically actuated hydraulic control valves 711-717, and an electronic controller 736 that generates the electrical signals 701-707 that actuate the control valves. Each of the hydraulic control valves 711-717 is a three-way valve. A first port is coupled to a high pressure hydraulic fluid supply line 730. A second port is coupled to a low pressure hydraulic fluid supply line 732. A third port is coupled to a hydraulic volume below each of the hydraulic plungers 611-617 to supply either low or high pressure hydraulic fluid according to the electrical signals 701-707 generated by the electronic controller 736.

It will be noted that each of the hydraulic control valves 711-717 is controlled independently of the other control valves, which provides considerable flexibility is the operation of the engine. The amount of energy being converted to pressurization of the hydraulic fluid during the expansion stroke of the combustion piston is not constrained by the mechanical arrangement of a crankshaft and connecting rod nor by mechanical coupling of the motion of the combustion piston to any other piston in the engine.

The electronic controller 736 receives electrical inputs from one or more sensors 734 that provide information about engine conditions such as combustion piston position, cylinder pressure, and the like. The electronic controller also receives other inputs related to operating conditions such as accumulator pressure 738. The electronic controller 736 can use the inputs in any of a variety of ways to generate the electrical signals 701-707 that control the operation of the combustion piston.

One or more hydraulic plungers 617 receive high pressure hydraulic fluid in an upper hydraulic volume to create a downward force on the combustion piston. This allows the combustion piston to be moved from top dead center to bottom dead center for an intake stroke. In the embodiment illustrated, high pressure hydraulic fluid is supplied to the upper hydraulic volume continuously. The upper control surface of the hydraulic plunger 617 has a smaller area than the lower control surface. Thus switching the lower hydraulic volume from low to high pressure hydraulic fluid creates a net upward force. In other embodiments, an addition three-way control valve is used to switch the upper hydraulic volume from low to high pressure hydraulic fluid.

Figure 18:
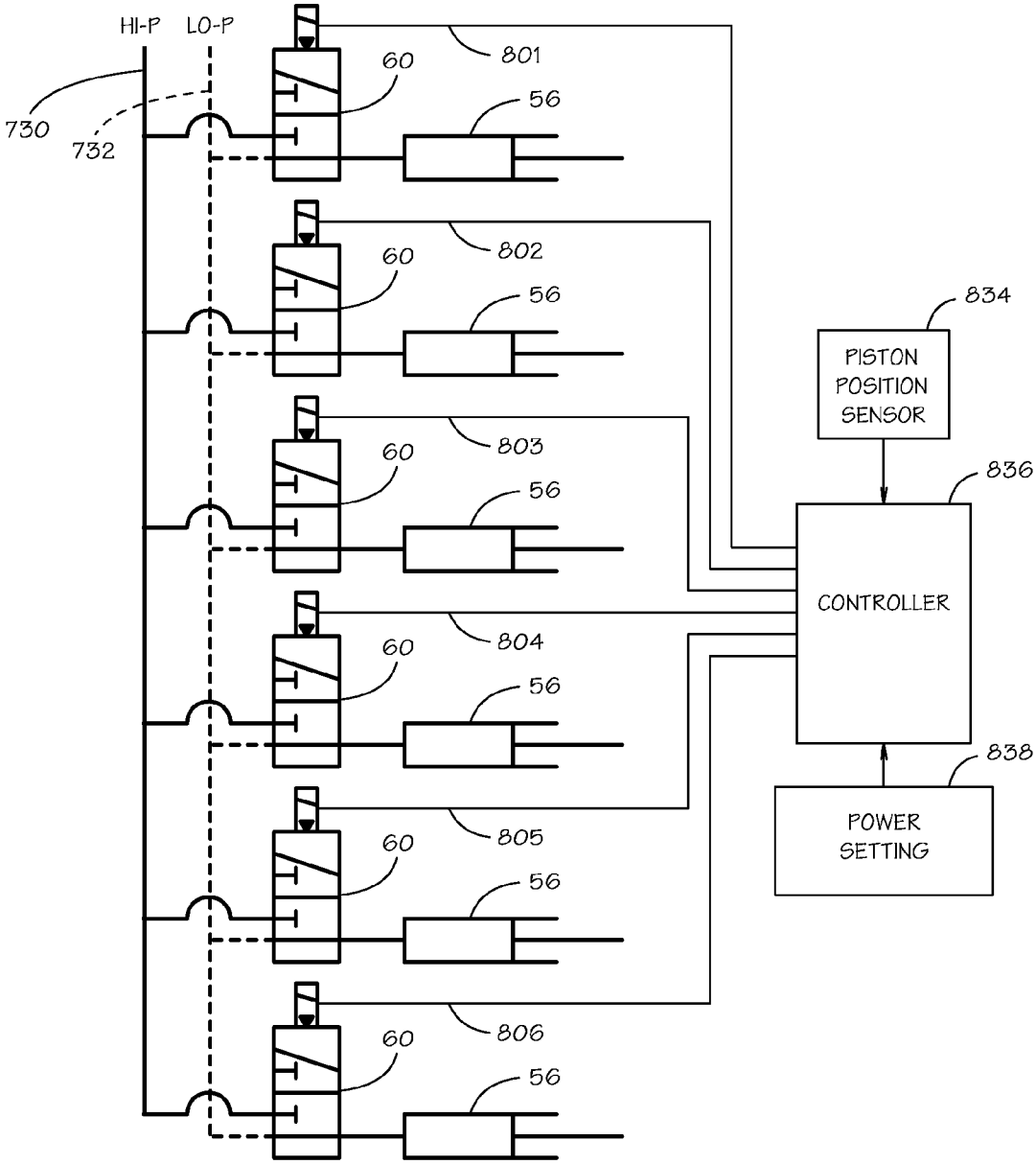
FIG. 18 is a schematic diagram of the valves and control system that may be used with a power train in accordance with the present invention.

FIG. 18 is a schematic view of the hydraulic plungers 56 and their associated electrically actuated hydraulic control valves 60 that may be used with the power converter arrangement for converting hydraulic power to mechanical power shown in FIG. 6. It will be seen that this is almost identical to the arrangement described above for controlling the generation of hydraulic power described above.

An electronic controller 836 generates the electrical signals 801-806 that actuate the control valves 60. The electronic controller 836 receives electrical inputs from one or more sensors 834 that provide information about the power converter conditions such as drive piston position, output rotational speed, and the like. The electronic controller also receives other inputs related to operating conditions such as power setting 838 (e.g. accelerator position). The electronic controller 836 can use the inputs in any of a variety of ways to generate the electrical signals 801-806 that control the operation of the combustion piston. The electronic controller 836 for the power converter may be the same as the electronic controller 736 for combustion piston control or it may be a separate device. Because of the large number of electrical signals that need to be generated with precise timing requirements, the electronic controllers 736, 836 may use a plurality of processors to provide the necessary amount of computational power to control the engine with the necessary precision and flexibility.

Figure 19:
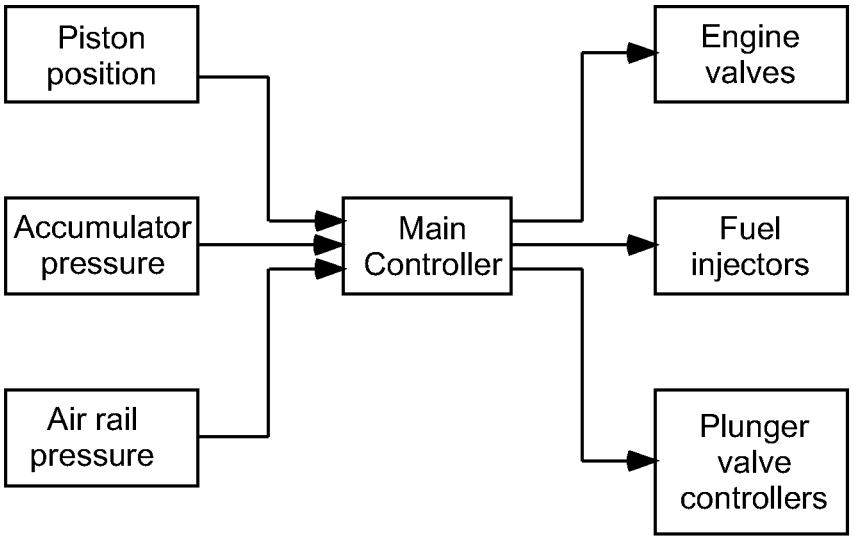
FIG. 19 is a schematic block diagram of an exemplary overall control system for a multi-cylinder engine in accordance with the present invention.

FIG. 19 presents an overall block diagram of a Main Controller for a multi-cylinder engine in accordance with the present invention, independent of whether the engine has dedicated compression cylinders for air injection and independent of the engine operating cycle or cycles used, though if spark ignition is used, then the word fuel injectors should be changed to spark plugs. As shown in FIG. 19, in this embodiment, a Main Controller monitors the piston position of each piston in the engine as well as the high pressure Accumulator Pressure and Air Rail Pressure or air tank pressure (FIG. 3) if air compression and injection is used, and provides control signals to the Engine Valve actuation system, to the Fuel Injectors (or Spark Plugs if used), and to the Plunger Valve Controllers of FIG. 17. In this embodiment, the Plunger Valve Controllers of FIG. 17 are assumed to operate independently of the Main Controller, once initiated, though the Main Controller may provide operating parameters to the Plunger Valve Controllers if desired. In that regard, the amount of subdivision of system control used, where that subdivision occurs, etc. is a matter of design choice and not part of the present invention, though some subdivision, such as just described, can be advantageous for trouble shooting purposes, and to reduce the cost of a replacement controller if in fact something does fail. Thus the words controller and electronic controller as used herein and in the claims to follow are used in a most general sense to mean and include any and all subdivisions of the control of an engine and drive train of the present invention, typically but not necessarily using processor control with look-up tables with iterative control corrections based on recent past performance. The monitoring of the high pressure Accumulator Pressure and Air Rail Pressure or air tank pressure (FIG. 3) if air compression and injection is used is to control the operation of the engine as required to maintain the optimum high pressure Accumulator Pressure and Air Rail Pressure or air tank pressure. Note that the air compression pistons may operate independently of any other piston, combustion or air compression.

It was previously noted that the pistons may operate with piston velocities approximately corresponding generally to operation of a crankshaft type engine running at, for example, 2400 revolutions per minute, but in fact may pause at some piston position for whatever time is appropriate depending on the high pressure hydraulic fluid delivery rate then needed. In that regard, unlike a crankshaft engine, the piston motion profiles and velocities may be fully controlled, and may be different for each of a compression stroke, a combustion or power stroke, and exhaust stroke and an intake stroke for a four stroke operation (two stroke operation is also possible) as desired, independent of the motion of any other combustion piston, or compression piston, if used. Also each may be tailored for the current needs of the engine. By way of example, the loss of heat of compression and combustion to the cylinder walls can be substantial in conventional engines at idle or in slow turning engines. In engines in accordance with the present invention, the compression and combustion or power strokes may be purposely made faster (higher piston speeds) than the intake and exhaust strokes (unless for instance, full power is needed) to increase the thermal efficiency. More specifically, the compression and power strokes may be chosen to balance the increased thermal efficiency with the reduced hydraulic efficiency at higher piston speeds to provide a maximum efficiency operating point for the engine, with pauses between cycles as needed. For starting the engine, it may be appropriate to maximize the combustion piston speed for the compression stroke, independent of efficiency considerations, to assure the maximum temperature rise from the compression, even if intake air heaters are used. In that regard, it is the speed of operation of the control valves used as well as the ability to control all aspects of the engines of the present invention in both timing and quantity that provides the extreme flexibility in operating cycles and fuels that may be used and still achieve highly efficient operation. In that regard, typically the engine controllers, such as the main controller of FIG. 19 and/or the plunger valve controller of FIG. 17, will monitor piston position and velocity for control purposes, and will also monitor hydraulic control valve settings and piston acceleration to sense the start of combustion and the rate and amount of pressure rise in the combustion chamber, and will make cycle to cycle incremental or iterative adjustments to obtain ignition exactly when desired and to balance the power output of each combustion cylinder by balancing the fuel injector operation and engine valve operation, if needed.

Thus the present invention has a number of aspects, which aspects may be practiced alone or in various combinations or sub-combinations, as desired. While preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. An internal combustion engine comprising:

a combustion piston in a combustion cylinder defining a combustion chamber above the combustion piston, the combustion chamber having electronically controlled intake and exhaust valves, the combustion piston not being mechanically connected to any other combustion piston or air compression piston each combustion cylinder having an electronically controlled valve for injection of high pressure air from a high pressure air rail into the combustion chamber;

a combustion piston position sensor;

a plurality of hydraulic plungers under the combustion piston, each in a respective hydraulic cylinder, the hydraulic cylinders being coupled to electronically controlled hydraulic cylinder valving for controllably coupling each hydraulic cylinder to a high pressure hydraulic system or a low pressure hydraulic system; and a controller, the controller controlling the electronically controlled hydraulic cylinder valving and the electronically controlled intake and exhaust valves to control both the upward and the downward motion of the combustion piston in the combustion cylinder responsive to an output of the combustion piston position sensor:

each combustion cylinder includes an electronically controlled valve for injection of high pressure air from a high pressure air rail into the combustion chamber, an air compression piston in an air compression cylinder defining an air compression chamber above the air compression piston, the air compression chamber having an intake valve and a valve for delivering high pressure air to the high pressure air rail, the air compression piston not being mechanically connected to any other combustion piston or air compression piston;

an air compression piston position sensor;

a plurality of hydraulic plungers under the air compression piston, each in a respective hydraulic cylinder, the hydraulic cylinders being coupled to electronically controlled valving for controllably coupling each hydraulic cylinder to the high pressure hydraulic system or the low pressure hydraulic system; and the controller controlling the electronically controlled hydraulic cylinder valving and the electronically controlled intake and exhaust valves to control both the upward and the downward motion of the combustion piston in the combustion cylinder, both the upward and the downward motion of the air compression piston in the air compression cylinder responsive to an output of the air compression piston position sensor, and also to control the electronically controlled valve for injection of high pressure air from the high pressure air rail into the combustion chamber.

2. The internal combustion engine of claim 1 further comprising an electronically controlled fuel injector disposed to controllably inject fuel into the combustion chamber, the controller also controlling the electronically controlled fuel injector.

3. The internal combustion engine of claim 2 wherein the controller causes the combustion piston to successively execute an intake stroke, a compression stroke, a power stroke and an exhaust stroke for the combustion piston and to successively execute intake and air compression strokes for the air compression piston.

4. The internal combustion engine of claim 3 wherein the controller causes the electronically controlled fuel injector to inject fuel into the combustion chamber during the intake stroke or the beginning of the compression stroke, and to inject air from the air rail but not fuel into the combustion chamber during the power stroke after compression ignition of the fuel to sustain combustion until all the fuel then in the combustion chamber is consumed.

5. The internal combustion engine of claim 3 wherein all cylinders have a construction of both combustion cylinders and air compression cylinders, and wherein each cylinder may be operated by the controller as an air compression cylinder at one time and as a combustion cylinder at another time.

6. The internal combustion engine of claim 3 wherein one cylinder is always operated as an air compression cylinder and the other cylinder is always operated as a combustion cylinder.

7. The internal combustion engine of claim 2 further comprising:

an output piston in an output cylinder and connected to a crankshaft through a connecting rod below the output piston;

a plurality of output hydraulic plungers above and acting on the output piston, each in a respective output hydraulic cylinder, the output hydraulic cylinders being coupled to electronically controlled output hydraulic cylinder valving for controllably coupling each output hydraulic cylinder to a high pressure hydraulic system or a low pressure hydraulic system to drive the crankshaft in rotation;

the controller also controlling the electronically controlled output hydraulic cylinder valving responsive to a power setting.

8. The internal combustion engine of claim 7 wherein the controller controls the combustion piston responsive to the pressure in the high pressure hydraulic system.

9. An internal combustion engine comprising:

a combustion cylinder;

a combustion piston in the combustion cylinder defining a combustion chamber above a first surface of the combustion piston, the motion of the combustion piston not being mechanically fastened to move in unison with any other combustion or compression piston in the internal combustion engine;

at least one pair of first hydraulic cylinders, the first hydraulic cylinders of each pair of first hydraulic cylinders being located on opposite sides of a diameter of the combustion cylinder equidistant from a central axis of the combustion cylinder;

a plurality of first hydraulic plungers, each of the plurality of first hydraulic plungers within one of the first hydraulic cylinders and disposed with respect to a second surface of the combustion piston to reciprocate with the combustion piston;

at least two electrically actuated first hydraulic fluid control valves coupled to at least one of the first hydraulic cylinders to selectively couple each pair of first hydraulic cylinders to a high pressure hydraulic line or a low pressure hydraulic line;

a center hydraulic cylinder aligned with the central axis of the combustion cylinder; and a center hydraulic plunger coupled to the second surface of the combustion piston and in the center hydraulic cylinder, the center hydraulic plunger provides two opposing hydraulic control surfaces that allow the hydraulic plunger to push and pull the combustion piston along the central axis;

wherein one of the electrically actuated first hydraulic fluid control valves is coupled to the center hydraulic cylinder to selectively couple the center hydraulic cylinder to a high pressure hydraulic line independently of the first hydraulic cylinders;

a combustion piston position sensor to sense the position of the combustion piston within the combustion cylinder;

a controller coupled to the position sensor and the at least one electrically actuated first hydraulic fluid control valves to selectively provide electrical signals to the first hydraulic fluid control valves responsive to the sensor and thereby couple the first hydraulic cylinders to the high pressure hydraulic line and provide a variable and reversible force on the combustion piston, and to provide electronic control to the fuel injector and intake and exhaust valves;

an air rail;

at least one compression cylinder having a compression piston in the compression cylinder defining a compression chamber above a first surface of the compression piston;

an electronically controlled intake valve coupled to the compression chamber;

at least one pair of second hydraulic cylinders, the second hydraulic cylinders of each pair of second hydraulic cylinders being located on opposite sides of a diameter of the compression cylinder equidistant from a central axis of the compression cylinder;

a plurality of second hydraulic plungers, each of the plurality of second hydraulic plungers within one of the second hydraulic cylinders and disposed with respect to a second surface of the compression piston to cause the compression piston to reciprocate; and at least one electrically actuated second hydraulic fluid control valve coupled to the second hydraulic cylinders to selectively couple each pair of second hydraulic cylinders to a high pressure hydraulic line or a low pressure hydraulic line;

each combustion cylinder having an electronically controlled air injection valve for injection of air compressed by the compression cylinder into each combustion cylinder.

10. The internal combustion engine of claim 9 further comprising:

an electronically controlled fuel injector disposed to inject fuel into the combustion chamber;

electronically controlled intake and exhaust valves coupled to the combustion chamber.

11. The internal combustion engine of claim 9 further comprising:

a drive cylinder;

a drive piston that slides within the drive cylinder along a central axis of the drive cylinder;

a crankshaft coupled to a first side of the drive piston by a connecting rod;

at least one pair of third hydraulic cylinders, the third hydraulic cylinders of each pair of third hydraulic cylinders being located on opposite sides of a diameter of the drive cylinder equidistant from a central axis of the drive cylinder;

a plurality of third hydraulic plungers, each of the plurality of third hydraulic plungers within one of the third hydraulic cylinders and arranged to press against a second side of the drive piston opposite the first side; and at least one electrically actuated third hydraulic fluid control valve coupled to the third hydraulic cylinders to selectively couple each pair of third hydraulic cylinders to a high pressure hydraulic line or a low pressure hydraulic line, whereby the second plurality of hydraulic plungers move the drive piston and cause the crankshaft to rotate.

12. An internal combustion engine comprising:

a combustion cylinder;

a combustion piston in the combustion cylinder defining a combustion chamber above a first surface of the combustion piston, the motion of the combustion piston not being mechanically fastened to move in unison with any other combustion or compression piston in the internal combustion engine;

at least one pair of first hydraulic cylinders, the first hydraulic cylinders of each pair of first hydraulic cylinders being located on opposite sides of a diameter of the combustion cylinder equidistant from a central axis of the combustion cylinder;

a plurality of first hydraulic plungers, each of the plurality of first hydraulic plungers within one of the first hydraulic cylinders and disposed with respect to a second surface of the combustion piston to reciprocate with the combustion piston; and at least one electrically actuated first hydraulic fluid control valve coupled to at least one of the first hydraulic cylinders to selectively couple each pair of first hydraulic cylinders to a high pressure hydraulic line or a low pressure hydraulic line;

at least one compression cylinder having a compression piston in the compression cylinder defining a compression chamber above a first surface of the compression piston;

an electronically controlled intake valve coupled to the compression chamber;

at least one pair of second hydraulic cylinders, the second hydraulic cylinders of each pair of second hydraulic cylinders being located on opposite sides of a diameter of the compression cylinder equidistant from a central axis of the compression cylinder;

a plurality of second hydraulic plungers, each of the plurality of second hydraulic plungers within one of the second hydraulic cylinders and disposed with respect to a second surface of the compression piston to cause the compression piston to reciprocate; and at least one electrically actuated second hydraulic fluid control valve coupled to the second hydraulic cylinders to selectively couple each pair of second hydraulic cylinders to a high pressure hydraulic line or a low pressure hydraulic line;

each combustion cylinder having an electronically controlled air injection valve for injection of air compressed by the compression cylinder into each combustion cylinder.

13. An internal combustion engine comprising:

a combustion cylinder;

a combustion piston in the combustion cylinder defining a combustion chamber above a first surface of the combustion piston, the motion of the combustion piston not being mechanically fastened to move in unison with any other combustion or compression piston in the internal combustion engine;

at least one pair of first hydraulic cylinders, the first hydraulic cylinders of each pair of first hydraulic cylinders being located on opposite sides of a diameter of the combustion cylinder equidistant from a central axis of the combustion cylinder;

a plurality of first hydraulic plungers, each of the plurality of first hydraulic plungers within one of the first hydraulic cylinders and disposed with respect to a second surface of the combustion piston to reciprocate with the combustion piston; and at least one electrically actuated first hydraulic fluid control valve coupled to at least one of the first hydraulic cylinders to selectively couple each pair of first hydraulic cylinders to a high pressure hydraulic line or a low pressure hydraulic line;

further comprising for each combustion cylinder:

an electronically controlled fuel injector disposed to inject fuel into the combustion chamber;

electronically controlled intake and exhaust valves coupled to the combustion chamber.

14. An internal combustion engine comprising:

a combustion cylinder;

a combustion piston in the combustion cylinder defining a combustion chamber above a first surface of the combustion piston, the motion of the combustion piston not being mechanically fastened to move in unison with any other combustion or compression piston in the internal combustion engine;

at least one pair of first hydraulic cylinders, the first hydraulic cylinders of each pair of first hydraulic cylinders being located on opposite sides of a diameter of the combustion cylinder equidistant from a central axis of the combustion cylinder;

a plurality of first hydraulic plungers, each of the plurality of first hydraulic plungers within one of the first hydraulic cylinders and disposed with respect to a second surface of the combustion piston to reciprocate with the combustion piston; and at least one electrically actuated first hydraulic fluid control valve coupled to at least one of the first hydraulic cylinders to selectively couple each pair of first hydraulic cylinders to a high pressure hydraulic line or a low pressure hydraulic line;

a drive cylinder;

a drive piston that slides within the drive cylinder along a central axis of the drive cylinder;

a crankshaft coupled to a first side of the drive piston by a connecting rod;

at least one pair of third hydraulic cylinders, the third hydraulic cylinders of each pair of third hydraulic cylinders being located on opposite sides of a diameter of the drive cylinder equidistant from a central axis of the drive cylinder;

a plurality of third hydraulic plungers, each of the plurality of third hydraulic plungers within one of the third hydraulic cylinders and arranged to press against a second side of the drive piston opposite the first side; and at least one electrically actuated third hydraulic fluid control valve coupled to the third hydraulic cylinders to selectively couple each pair of third hydraulic cylinders to a high pressure hydraulic line or a low pressure hydraulic line, whereby the second plurality of hydraulic plungers move the drive piston and cause the crankshaft to rotate.

15. A method of operating an internal combustion engine comprising:

providing a combustion cylinder having a combustion piston in the combustion cylinder defining a combustion chamber above a first surface of the combustion piston, the motion of the combustion piston not being mechanically fastened to move in unison with any other combustion or compression piston in the internal combustion engine;

selectively operating at least one electrically actuated first hydraulic fluid control valve to selectively provide high pressure or low pressure hydraulic fluid to at least one pair of first hydraulic cylinders acting on a second surface of the combustion piston to cause the combustion piston to compress the contents of the combustion chamber in a compression stroke, each first hydraulic cylinder including a first hydraulic plunger, each pair of the first hydraulic cylinders being substantially equal in diameter and located on a diameter of the combustion cylinder, equally and oppositely spaced from a center of the combustion cylinder, and each of the plurality of first hydraulic fluid control valves coupled to at least one of the first hydraulic cylinders to selectively couple the first hydraulic cylinders in diametrically opposite pairs to the high pressure hydraulic line independently of the remaining first hydraulic cylinders;

providing fuel and air to the combustion chamber at least by the time the contents of the combustion chamber are compressed and ready to ignite; and selectively operating the plurality of first hydraulic fluid control valves to receive high pressure hydraulic fluid from diametrically opposite pairs of the plurality of first hydraulic cylinders coupled to the combustion piston during a power stroke following ignition of the fuel;

injecting air into the combustion cylinder during combustion in the power stroke;

the plurality of electrically actuated first hydraulic fluid control valves being operated to control the combustion piston velocity and limits of travel during the compression and power stroke.

16. A method of operating an internal combustion engine comprising:

providing a combustion cylinder having a combustion piston in the combustion cylinder defining a combustion chamber above a first surface of the combustion piston, the motion of the combustion piston not being mechanically fastened to move in unison with any other combustion or compression piston in the internal combustion engine;

selectively operating at least one electrically actuated first hydraulic fluid control valve to selectively provide high pressure or low pressure hydraulic fluid to at least one pair of first hydraulic cylinders acting on a second surface of the combustion piston to cause the combustion piston to compress the contents of the combustion chamber in a compression stroke, each first hydraulic cylinder including a first hydraulic plunger, each pair of the first hydraulic cylinders being substantially equal in diameter and located on a diameter of the combustion cylinder, equally and oppositely spaced from a center of the combustion cylinder, and each of the plurality of first hydraulic fluid control valves coupled to at least one of the first hydraulic cylinders to selectively couple the first hydraulic cylinders in diametrically opposite pairs to the high pressure hydraulic line independently of the remaining first hydraulic cylinders;

providing ammonia and air to the combustion chamber at least by the time the contents of the combustion chamber are compressed and ready to ignite; and selectively operating the plurality of first hydraulic fluid control valves to receive high pressure hydraulic fluid from diametrically opposite pairs of the plurality of first hydraulic cylinders coupled to the combustion piston during a power stroke following ignition of the ammonia;

the plurality of electrically actuated first hydraulic fluid control valves being operated to control the combustion piston velocity and limits of travel during the compression and power stroke.

17. A method of operating an internal combustion engine comprising:

providing a combustion cylinder having a combustion piston in the combustion cylinder defining a combustion chamber above a first surface of the combustion piston, the motion of the combustion piston not being mechanically fastened to move in unison with any other combustion or compression piston in the internal combustion engine;

selectively operating at least one electrically actuated first hydraulic fluid control valve to selectively provide high pressure or low pressure hydraulic fluid to at least one pair of first hydraulic cylinders acting on a second surface of the combustion piston to cause the combustion piston to compress the contents of the combustion chamber in a compression stroke, each first hydraulic cylinder including a first hydraulic plunger, each pair of the first hydraulic cylinders being substantially equal in diameter and located on a diameter of the combustion cylinder, equally and oppositely spaced from a center of the combustion cylinder, and each of the plurality of first hydraulic fluid control valves coupled to at least one of the first hydraulic cylinders to selectively couple the first hydraulic cylinders in diametrically opposite pairs to the high pressure hydraulic line independently of the remaining first hydraulic cylinders;

providing ammonia and air to the combustion chamber at least by the time the contents of the combustion chamber are compressed and ready to ignite, the ammonia being put into the combustion chamber at the beginning of or before the compression stroke; and selectively operating the plurality of first hydraulic fluid control valves to receive high pressure hydraulic fluid from diametrically opposite pairs of the plurality of first hydraulic cylinders coupled to the combustion piston during a power stroke following ignition of the ammonia;

the plurality of electrically actuated first hydraulic fluid control valves being operated to control the combustion piston velocity and limits of travel during the compression and power stroke;

wherein air and not fuel is injected into the combustion cylinder during combustion in the power stroke.

* * * * *